US010865076B1

(12) United States Patent
Schrank et al.

(10) Patent No.: US 10,865,076 B1
(45) Date of Patent: Dec. 15, 2020

(54) CONFINED-SPACE DAVIT

(71) Applicant: 3M INNOVATIVE PROPERTIES COMPANY, St. Paul, MN (US)

(72) Inventors: Greg E. Schrank, Bloomington, MN (US); Andrew C. Strauss, Goodhue, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/733,187

(22) PCT Filed: Dec. 13, 2018

(86) PCT No.: PCT/IB2018/060040
§ 371 (c)(1),
(2) Date: Jun. 5, 2020

(87) PCT Pub. No.: WO2019/123145
PCT Pub. Date: Jun. 27, 2019

Related U.S. Application Data

(60) Provisional application No. 62/607,415, filed on Dec. 19, 2017.

(51) Int. Cl.
*B66C 23/16* (2006.01)
*B66C 23/70* (2006.01)
*B66C 23/06* (2006.01)

(52) U.S. Cl.
CPC ..... *B66C 23/166* (2013.01); *B66C 23/06* (2013.01); *B66C 23/701* (2013.01); *B66C 2700/03* (2013.01)

(58) Field of Classification Search
CPC ..... B66C 23/701; B66C 23/166; B66C 23/06; B66C 2700/03
See application file for complete search history.

(56) References Cited

U.S. PATENT DOCUMENTS 1,010,530 A * 12/1911 Taylor ..... B66C 23/94 212/223
1,677,714 A 7/1928 Frease
2,604,303 A * 7/1952 Grady ..... B66C 23/22 254/326

(Continued)

FOREIGN PATENT DOCUMENTS

CA 2386486 5/2007
CN 203728452 7/2014

(Continued)

OTHER PUBLICATIONS

UCL Safety System, Confined Space Fall Protection Safety Systems, 2006, 16 pages.

(Continued)

*Primary Examiner* — Sang K Kim
*Assistant Examiner* — Nathaniel L Adams
(74) *Attorney, Agent, or Firm* — Kenneth B. Wood

(57) ABSTRACT

A confined-space davit, including a vertical, elongate mast provided by at least one annular tube; and, a boom that is pivotally connected to an upper end portion of the mast and that extends forwardly from the mast. The tube comprises a forward wall and an opposing rearward wall and comprises left and right opposing lateral sidewalls that each connect the forward wall to the rearward wall.

20 Claims, 18 Drawing Sheets

(56) References Cited

U.S. PATENT DOCUMENTS

| | | | | |
|---|---|---|---|---|
| 2,888,111 | A * | 5/1959 | Evans | E04H 12/32 52/114 |
| 2,910,190 | A * | 10/1959 | Baas | E02F 3/38 212/347 |
| 3,464,450 | A | 9/1969 | Steffenini | |
| 4,090,625 | A * | 5/1978 | Walters | B66C 23/48 212/55 |
| 4,674,256 | A | 6/1987 | Chailleux | |
| 5,371,988 | A | 12/1994 | Hannes | |
| 6,899,238 | B2 | 5/2005 | Austin | |
| 7,213,715 | B2 | 5/2007 | Boily | |
| 7,434,366 | B2 | 10/2008 | Zahner | |
| 9,630,816 | B1 | 4/2017 | Napieralksi | |
| RE46,619 | E | 12/2017 | Chilton | |
| 10,287,138 | B2 | 5/2019 | Italiano | |
| 10,315,892 | B2 | 6/2019 | Almeda | |
| 2007/0227995 | A1 | 10/2007 | Casebolt | |
| 2016/0115001 | A1 | 4/2016 | Italiano | |
| 2016/0221802 | A1 | 8/2016 | Almeda | |
| 2017/0247236 | A1 | 8/2017 | Svoboda | |

FOREIGN PATENT DOCUMENTS

| | | |
|---|---|---|
| EP | 1004784 | 1/2004 |
| EP | 3023380 | 5/2016 |
| EP | 3210650 | 8/2017 |
| GB | 2160170 | 12/1985 |
| JP | 7035494 | 7/1995 |
| JP | 7035496 | 7/1995 |

OTHER PUBLICATIONS

International Search Report for PCT International Application No. PCT/IB2018/060040, dated Apr. 18, 2019, 3 pages.

* cited by examiner

CONFINED-SPACE DAVIT

BACKGROUND

Confined-space davits provide fall protection for a worker during entry, exit, and/or while performing tasks, in a confined space. Such davits may also assist in lowering the worker into the confined space and/or hoisting the worker out of the confined space. Such davits often comprise a vertical mast with a boom extending forwardly therefrom, with various devices (e.g. one or more winches or self-retracting lifelines) being mounted on the davit and supported thereby.

SUMMARY

In broad summary, herein is disclosed a confined-space davit, comprising a vertical, elongate mast provided by at least one annular tube; and, a boom that is pivotally connected to an upper end portion of the mast and that extends forwardly from the mast. The tube comprises a forward wall and an opposing rearward wall and comprises left and right opposing lateral sidewalls that each connect the forward wall to the rearward wall. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
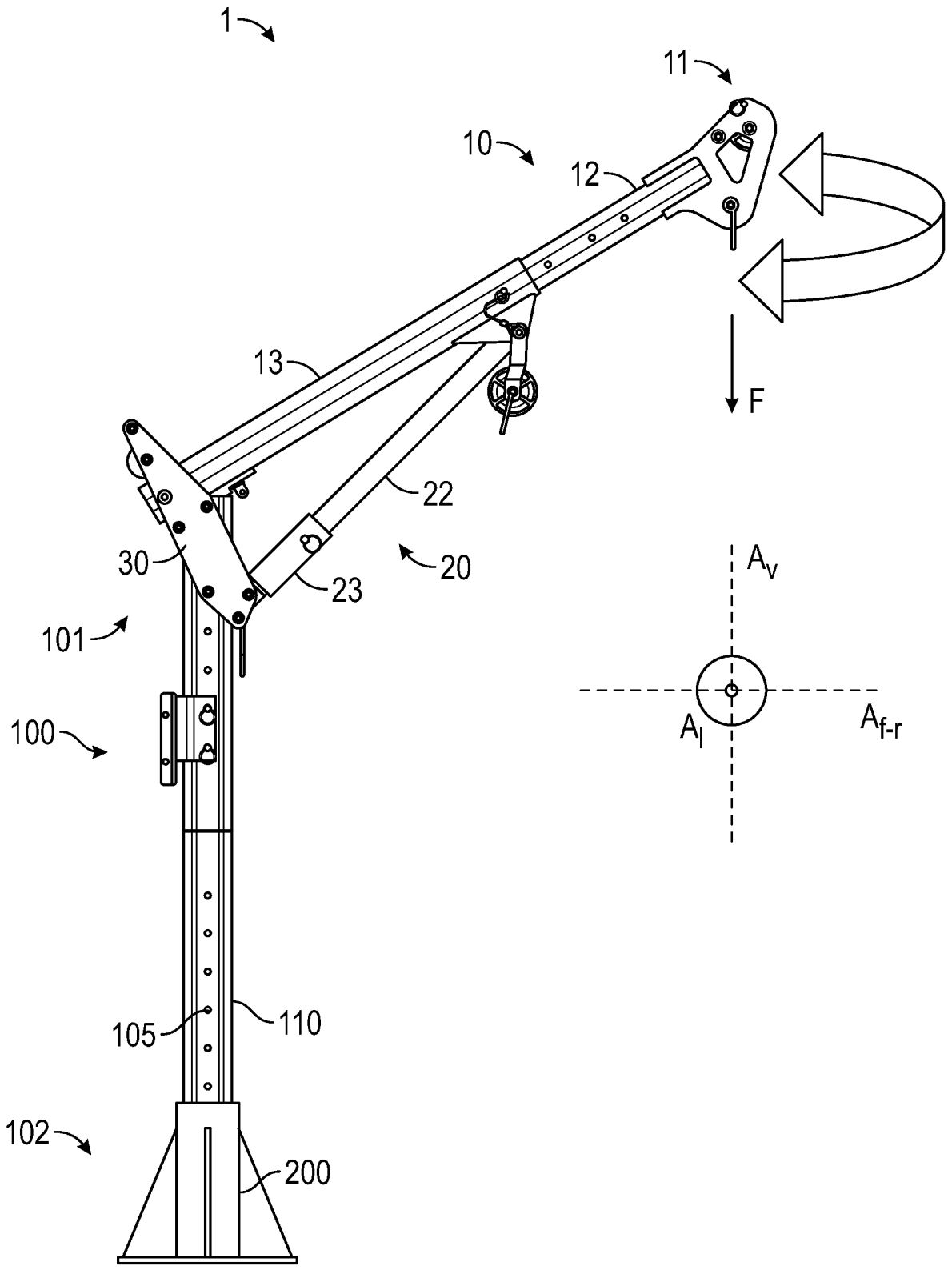
FIG. 1 is a side view of an exemplary confined-space davit as disclosed herein.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "first" and "second" may be used in this disclosure, it should be understood that those terms are used in their relative sense only unless otherwise noted.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). For angular orientations, the term "generally" means within clockwise or counterclockwise 30 degrees. The term "substantially", unless otherwise specifically defined, means to a high degree of approximation (e.g., within +/−5% for quantifiable properties). For angular orientations, the term "substantially" means within clockwise or counterclockwise 10 degrees. The term "essentially" means to a very high degree of approximation (e.g., within plus or minus 2% for quantifiable properties; within plus or minus 2 degrees for angular orientations); it will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. The term "configured to" and like terms is at least as restrictive as the term "adapted to", and requires actual design intention to perform the specified function rather than mere physical capability of performing such a function.

By a vertical axis is meant an axis that extends along the long axis of the mast of a davit, in an up-down direction aligned with the Earth's gravity, in accordance with the ordinary meaning of the term vertical. By a forward-rearward axis is mean an axis that extends along the boom of the davit (since, by definition, the boom extends forwardly from the mast of the davit and thus defines a forward direction for the boom, mast, and for the davit as a whole). Such a forward-rearward axis is thus a common axis (direction) for the boom, the mast, a tube that provides the mat, and for the davit as a whole. A lateral axis is one that extends from side to side, perpendicular to the forward-rearward axis and to the vertical axis. These axes are shown in various Figures and are discussed in detail later herein. By radially inward is meant a direction toward the geometric centerpoint of a mast, when viewed in cross-section along the vertical axis of the mast. By radially outward is meant an opposing direction, away from the centerpoint of the mast. (Terms such as radial, radially, circumferentially, annular, tube, etc., are used for convenience of description and do not require a strictly circular cross-sectional geometry of the item in question.)

DETAILED DESCRIPTION

Figure 2:
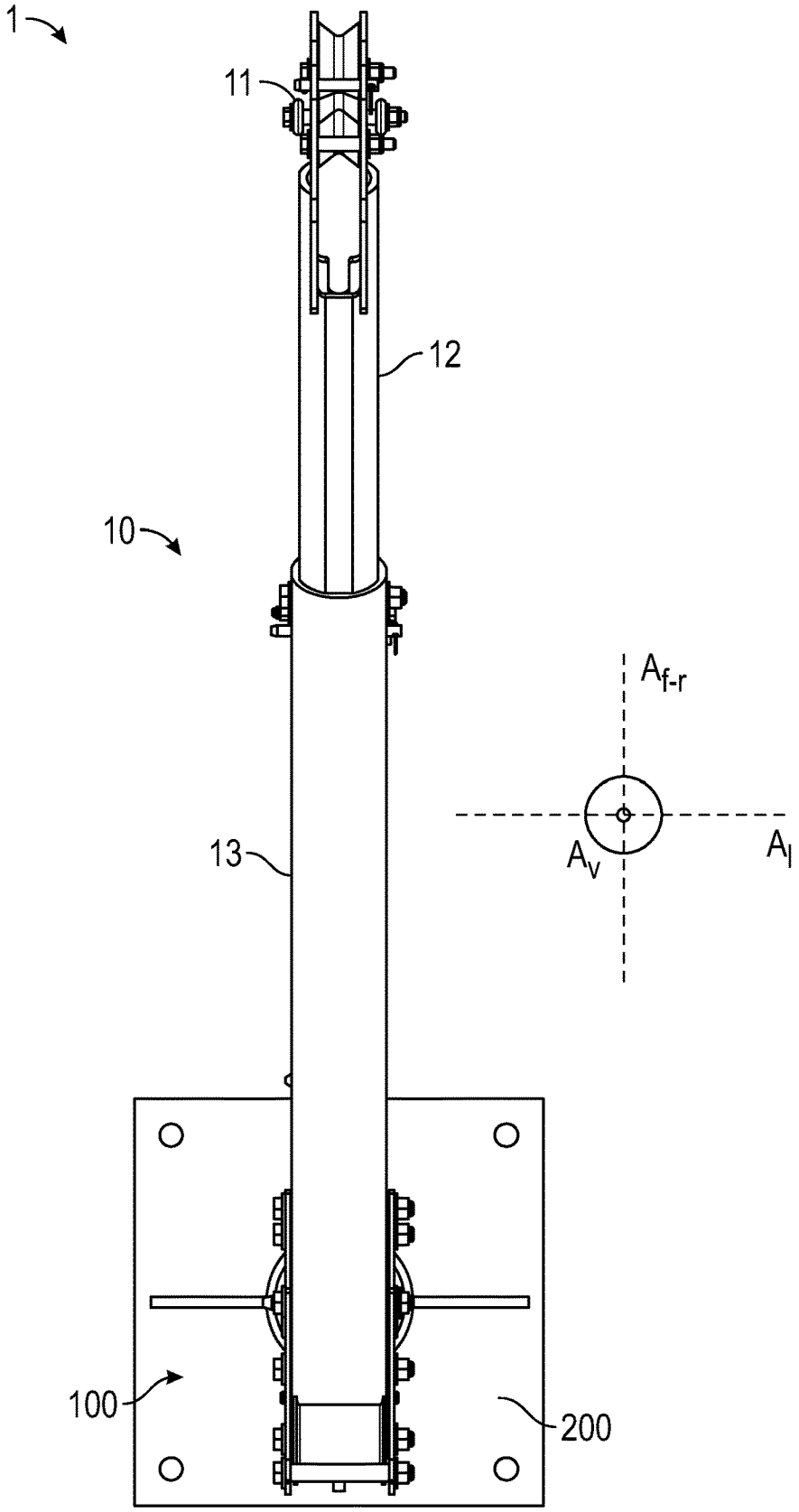
FIG. 2 is top view of the exemplary davit of FIG. 1.

Disclosed herein is a confined-space davit 1, as shown in exemplary embodiment in the side view of FIG. 1 and in the top view of FIG. 2. By "davit" is meant a hoist-like apparatus that is used for worker protection when entering a confined space (e.g. a manhole, a tank, etc.). A davit generally resembles a small crane, and comprises at least a vertical, elongate mast 100 and with a boom or arm 10 that is pivotally connected (e.g. by way of a bracket 30) to an upper end portion 101 of the mast. Boom 10 extends forwardly from mast 100 to define a forward direction and to define a forward-rearward axis that is shared in common by boom 10, mast 100, and davit 1 as a whole. This forward-rearward axis is denoted as axis $A_{f\text{-}r}$ in FIGS. 1 and 2 and other Figures herein. A vertical axis $A_v$ extends up and down along the long axis/elongate length of mast 100, and a lateral (left-right) axis $A_l$ extends perpendicular to the forward-rearward axis and to the vertical axis, all as shown in FIGS. 1 and 2 (noting that FIG. 2 is a top view looking down along the vertical axis). In some instances a minor portion of boom 10 may extend slightly rearwardly from mast 100 (as in FIG. 1); however, the major portion of the boom, that extends forwardly so as to define the forward direction of the boom, mast, and davit, will be easily identifiable.

A davit can provide fall protection for a worker while entering, leaving, or within a confined space, and/or may be used to at least partially assist the worker in being lowered into the confined space and/or in being hoisted out of the confined space. Accordingly, such a davit may act as a support for devices such as e.g. one or more of winches, self-retracting lifelines, and the like. Such devices may comprise one or more cables that may e.g. pass over or through the boomhead 11 of boom 10 to be supported thereby, and that comprise a distal end that is attachable e.g. to a harness that is worn by the worker.

At times during ordinary operation of davit 1, a force may be applied to boom 10 and thus to mast 100 of davit 1. Often, such a force is transmitted by one or more cables as mentioned above, that may bear at least a portion of the weight of a worker. Such an occurrence results in a generally downward force being applied to boom 10 as indicted by arrow "F" of FIG. 1, which in turn results in a force (e.g. a moment) being transmitted to mast 100. In addition to withstanding the static forces resulting from supporting the weight of the worker, boom 10 and mast 100 must also be capable of withstanding dynamic, peak forces that may be considerably higher e.g. during an arrest of a worker fall. It will thus be appreciated that mast 100 must exhibit sufficient strength to withstand the force (e.g., bending moment) encountered when a peak force F is applied to boom 10; in particular, mast 100 must be resistant to buckling under such forces. However, because confined-space davits are often required to be portable (e.g., they may be carried by hand), it is paramount that davit 1, and in particular mast 100, should be as lightweight as possible.

Figure 3:
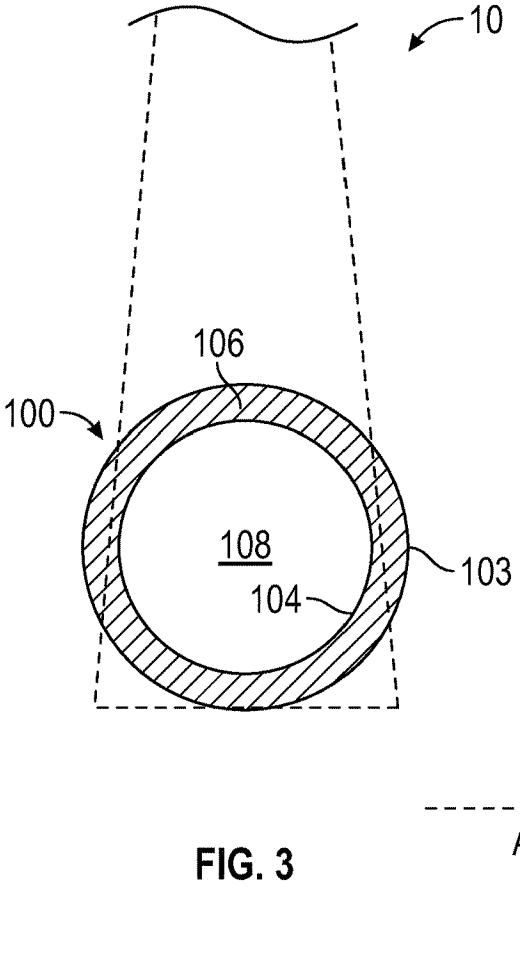
FIG. 3 is a generic depiction, in idealized representation, of a top view of an exemplary prior art davit comprising a vertical mast with a boom extending forwardly therefrom.

As disclosed herein, a mast 100 of a davit 1 may be configured to exhibit enhanced strength and resistance to buckling, while being as light in weight as possible. To illustrate the concepts disclosed herein, a generic depiction, in idealized representation, of an exemplary prior art davit comprising a conventional tubular vertical mast 100 with a boom 10 extending forwardly therefrom, is shown in FIG. 3. FIG. 3 is a top view, looking directly along the vertical axis of mast 100 with mast 100 shown in cross-section. Such a mast will comprise a radially outward major surface 103 and a radially inward major surface 104, that defines an elongate interior space 108 that extends the length of the mast. Much of elongate space 108 may be empty (i.e., air-filled); however, some portions of this space may, at certain times, be occupied by various items, e.g. portions of one or more of couplers, adaptors, pins, bolts, etc., as discussed later herein. Mast 100 will comprise a wall 106 that will exhibit a wall thickness.

Figure 4:
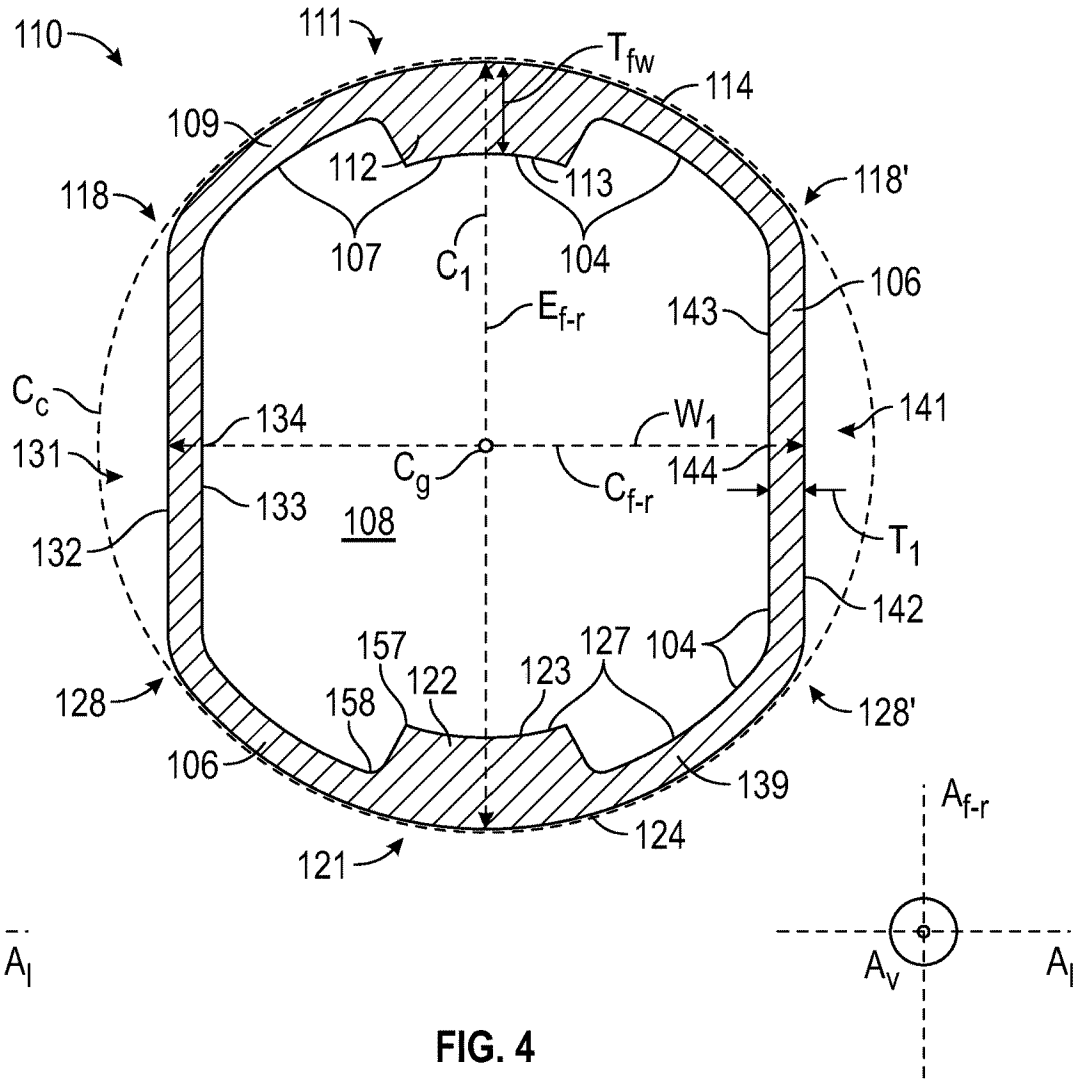
FIG. 4 is a cross-sectional top view of an exemplary tube of a mast of a confined-space davit.

A davit mast that exhibits enhanced strength and resistance to buckling, while remaining light in weight, is shown in exemplary embodiment in FIG. 4, which is a cross-sectional top view looking along the long axis of mast 100. In some embodiments, mast 100 may be comprised of a monolithic annular extruded aluminum tube 110. In some embodiments, mast 100 is provided by a single tube; in other embodiments, mast 100 may comprise multiple such tubes, mated in an end-to-end fashion, as described in detail later herein. By monolithic is meant that an individual aluminum tube 110 is a single, extruded piece of aluminum rather than being comprised of two or more pieces of aluminum that are made separately and are then are permanently joined to each other (by some means other than a coupler of the general type described later herein) to form the tube. A specific example of a structure that is not monolithic is a tube comprised of an elongate outer component (e.g. an outer sleeve) and an elongate inner component (e.g. an inner sleeve) that is slidably inserted into the interior of the outer component, e.g. as disclosed in U.S. Pat. No. 1,677,714 to Frease.

By annular is meant that tube 110, when viewed in cross-section along the vertical axis of the tube, completely circumferentially encircles interior space 108 of tube 110 along the majority of (e.g. along at least about 80, 90, or 95% of) the elongate length (along the long axis) of tube 110. This requirement (rather than requiring that tube 110 completely circumferentially encircles space 108 along the entire elongate length of the tube) is in view of the fact that in many embodiments one or more apertures (e.g. through-apertures 105 as visible in FIG. 1) may be provided at certain locations along tube 110 for various uses as discussed herein. Also, as noted above, terms such as annular, radial, circumferential and the like do not require that tube 110 must, when viewed in cross-section, take the form of a "perfect" circle e.g. of the type shown in FIG. 3. Indeed, in many embodiments tube 110 will be elongated along a forward-rearward axis rather than being strictly circular, as discussed in detail later herein.

In various embodiments, tube 110 may be made of any grade of aluminum that exhibits sufficient mechanical strength to meet the requirements of a davit mast, when configured according to the disclosures herein. The term "aluminum" broadly encompasses both elemental aluminum and any suitable aluminum alloy. In some embodiments, aluminum tube 110 may be made of an aluminum alloy that comprises copper (e.g. a series 2000 aluminum). In some embodiments, aluminum tube 110 may be made of an aluminum alloy that comprises at least silicon and magnesium (e.g. a series 6000 aluminum). In some embodiments, aluminum tube 110 may be made of an aluminum alloy that comprises zinc (e.g. a series 7000 aluminum). In particular embodiments, aluminum tube 110 may be made of an aluminum alloy that comprises zinc, magnesium, copper and chromium (e.g. series 7075 or 7175 aluminum). In other embodiments, at least one monolithic annular (e.g. extruded) tube 110 of mast 100 may be made of a metallic material that is not aluminum. For example, in some embodiments, titanium or a titanium alloy (e.g. with aluminum, vanadium, copper, iron, or manganese) may be used.

In some embodiments, at least one tube 110 of mast 100 may be made of a non-metallic material (although such a material may be reinforced with e.g. metallic fibers, as discussed below). In specific embodiments, such a tube may be made of an organic polymeric material that is reinforced with fibers (such materials are sometimes referred to as fiber-reinforced composites or fiber-reinforced polymers). Such fibers may be of any suitable type and composition (natural or synthetic), chosen from e.g. glass fibers, ceramic fibers, carbon fibers, aramid fibers, liquid crystal polymer fibers, homogeneous metallic fibers, stranded metallic fibers, and aluminum-ceramic or aluminum oxide fibers. Any such fibers may be compounded or otherwise combined with an appropriate organic polymeric material to form a fiber-reinforced composite. The organic polymeric material may be chosen from e.g. polyesters, vinyl esters, epoxies, phenol-formaldehyde and so on. The organic polymeric material may be a thermoplastic material or may be a thermosetting material.

The fibers and the organic polymeric material may be combined, and shaped into a tube suitable for a mast, using any suitable process. In some embodiments the fibers may be combined into a preform (e.g. a collection of fibers, e.g. a sheet or mat) before being combined with an organic polymeric matrix material in any suitable manner. In some embodiments the process(es) may be performed so that, in the thus-produced tube, the fibers exhibit long axes that are, on average, preferentially aligned with (e.g., within plus or minus 20 degrees of) the long axis of the tube. Suitable processes may be chosen from e.g. pultrusion, resin transfer molding, filament winding, and so on.

Potentially suitable materials may be screened e.g. by assessing the ultimate tensile strength of the material. In various embodiments, a potentially suitable material may exhibit an ultimate tensile strength of at least about 20000, 30000, 40000, 50000, 60000, or 70000 psi. However, it is emphasized that the final test for suitability of any such material will be its performance when actually incorporated into a davit and subjected to performance testing. Specifically, any suitable material for use in a tube as disclosed herein must exhibit an ability to withstand forces of at least 1800 pounds, when incorporated into a davit and tested according to the procedures outlined in Section 5.7.3 of Standard BS EN1496:2006: Personal Fall Protection Equipment—Rescue Lifting Devices, as specified in 2006. (Those having background knowledge in this area will readily understand that commonplace materials such as e.g. many extrudable polyolefins, polyvinylchlorides, and like materials, will not pass such a test). In various embodiments, a davit that includes a mast with a tube formed of a suitable material, may exhibit an acceptable ability to withstand forces of at least about 2200, 2500, 2800, or 3100 pounds, when tested according to the above-cited Standard.

In some embodiments a tube 110 (e.g. an aluminum tube) is an extruded tube, meaning that it was manufactured by being forced out under pressure through an orifice of a die, the orifice being shaped to create the desired cross-sectional design of the tube. By definition, such an extruded tube is integral, meaning that all portions of the tube (i.e., forward and rearward walls, and lateral sidewalls, and any bosses that may be present), were made of the same (extruded) material at the same time, rather than being assembled from separately-made parts. By definition, such an extruded tube will exhibit a cross-sectional configuration that is uniform (unvarying) along the length of the tube. That is, the tube will exhibit the same geometric appearance for any cross-sectional slice that is taken at any point along the long (vertical) axis of the tube. However, this requirement for geometric uniformity along the length of the tube extends only to the tube as originally manufactured by extrusion. This requirement does not preclude the removal of material to provide e.g. depressions or through-apertures in certain walls (e.g. sidewalls) of the tube, as may be desired e.g. to allow insertion of pins, bolts, or the like. Exemplary through-apertures 105 are visible in tube 110 of FIG. 1 as noted above; such features do not exclude the tube from exhibiting a cross-sectional configuration that is uniform along the length of the tube. Nor does this requirement preclude e.g. the removal of material from an end portion 101 of tube 110. For example, an upper terminal end of tube 110 may be angled or beveled so that a rearward end of boom 10 can be nestled more closely to the upper terminal end of tube 110. Similarly, if desired a lower terminal end of tube 110 may be beveled for ease of insertion into a support base. Nor does this requirement preclude the removal of material from an end portion of a tube e.g. to provide an interior scallop as discussed later herein.

This requirement for cross-sectional geometric uniformity along the length of the tube also does not preclude the addition of material such as e.g. adhesive, solder, welding materials, or the like. This requirement does however preclude tubes that are e.g. molded, forged, cast, or the like, so as to exhibit a cross-sectional configuration that is non-uniform along the length of the tube. If desired, at least some portion of the outward major surface of tube 110, and/or of the inward major surface of tube 110, may be e.g. painted, coated, anodized, or otherwise treated for functional and/or decorative effect. In specific embodiments any desired surfaces of tube 110 may be powder-coated.

A tube 110 (e.g. a monolithic annular aluminum tube) is shown in exemplary embodiment in the cross-sectional top view of FIG. 4. Tube 110 as disclosed herein comprises a forward wall 111, a rearward wall 121 that opposes forward wall 111, and left and right lateral sidewalls 131 and 141 that each connect forward wall 111 to rearward wall 121.

Forward wall 111 of tube 110 comprises a radially inward surface 107 that provides radially inward major surface 104 of that portion of mast 100, and a radially outward major surface 114 that provides radially outward major surface 103 of that portion of mast 100. Rearward wall 121 similarly comprises a radially inward major surface 127 that provides radially inward major surface 104 of that portion of mast 100, and a radially outward major surface 124 that provides radially outward major surface of that portion of mast 100. Left and right lateral sidewalls 131 and 141 respectively comprise radially inward major surfaces 133 and 143, and radially outward major surfaces 132 and 142.

In many embodiments tube 110 may exhibit a cross-sectional shape that is elongated along the common forward-rearward axis $A_{f\text{-}r}$ of the tube, boom and davit. In detail, tube 110, when viewed in cross-section along the vertical axis as in FIG. 4, will exhibit a forward-rearward extent ($E_{f\text{-}r}$ in FIG. 4) that is defined as the distance between a forwardmost location of radially outward major surface 114 of forward wall 111 and a rearwardmost location of radially outward major surface 124 of rearward wall 121, measured along the forward-rearward axis of the tube. Tube 110 will also exhibit a lateral (left-right) width ($W_l$ in FIG. 4) that is defined as the distance between a leftmost location of radially outward major surface 132 of left sidewall 131, and a rightmost location of radially outward major surface 142 of right sidewall 141. (It will be appreciated that in the exemplary design of FIG. 4, the arrowed line designating forward-rearward extent $E_{f\text{-}r}$ coincides with a lateral centerline $C_l$ of tube 110; likewise, the arrowed line designating lateral width $W_l$ coincides with a forward-rearward centerline $C_{f\text{-}r}$ of tube 110.) In various embodiments, tube 110 may be elongated along the forward-rearward axis such that the ratio of the forward-rearward extent to the lateral width is at least about 1.03, 1.06, 1.10, 1.14, 1.18, 1.20, 1.25, or 1.30. In further embodiments, this ratio is less than about 1.50, 1.40, 1.30, 1.20, or 1.15. (By way of specific example, this ratio for the exemplary design of FIG. 4 is approximately 1.2.)

In many embodiments, tube 110, when viewed in cross-sectional top view along the long axis of the tube, may exhibit exactly $2^{nd}$-order rotational symmetry with respect to rotation about the vertical axis of the tube. In such embodiments, tube 110 will not exhibit higher-order rotational symmetry. In other words, in such embodiments tube 110, when viewed as in FIG. 4, will be superimposable upon its original image if rotated 180 degrees about its vertical axis, but will not be superimposable if rotated a smaller amount (e.g., 90 degrees or 45 degrees). As noted above, in many embodiments tube 110 will exhibit a forward-rearward centerline (axis of reflection) $C_{f\text{-}r}$ and/or a lateral centerline (axis of reflection) $C_l$, as shown in FIG. 4.

In addition to, or instead of, being elongated in the forward-rearward direction, in some embodiments tube 110 may be configured to exhibit a maximum wall thickness of forward wall 111 and rearward wall 121, that is greater than the maximum wall thickness of each lateral sidewall 131 and 141. The wall thickness at any given location on a wall is the shortest distance between the radially inward major surface and the radially outward major surface at that location. By definition, the maximum wall thickness of a forward or rearward wall is measured at a location of the wall that is within an angular arc that has its origin at the geometric center ($C_g$ in FIG. 4) of the tube, that is centered on the lateral centerline CI of the tube, and that spans 60 degrees in angular width. By definition, the maximum wall thickness of a lateral sidewall is measured at a location of the sidewall that is within an angular arc that has its origin at geometric center $C_g$, that is centered on the forward-rearward centerline $C_{f\text{-}r}$ of the tube, and that spans 40 degrees in angular width. In other words, a maximum wall thickness of any given wall will be measured at a position that is at least generally centrally located along the circumferential extent of that wall, rather than being measured at a position close to a junction of that wall with a neighboring wall.

By way of example, the maximum wall thickness of forward wall 111 is identified in FIG. 4 as $T_{fw}$; the maximum wall thickness of right lateral sidewall 141 is identified in FIG. 4 as $T_l$. In various embodiments, forward and rearward walls 111 and 121 may each exhibit a maximum wall thickness that is greater than a maximum wall thickness of each lateral sidewall 131 and 141, by a factor of at least about 1.05, 1.1, 1.3, 1.5, 1.7, 1.9, 2.1, 2.3, or 2.5. In further embodiments, forward and rearward walls 111 and 121 may each exhibit a maximum wall thickness that is greater than a maximum wall thickness of each lateral sidewall 131 and 141, by a factor of at no more than about 5.0, 4.0, 3.0, 2.8, 2.6, 2.4, or 2.0. (By way of specific example, this ratio for the exemplary design of FIG. 4 is approximately 2.7.) In further embodiments, forward and rearward walls 111 and 121 may each exhibit a maximum wall thickness that is greater than a minimum wall thickness of each lateral sidewall 131 and 141, by a factor of at least about 1.4, 1.6, 1.8, 2.0, 2.2, or 2.4.

The consequences of elongating tube 110 along a forward-rearward axis and/or providing a greater maximum wall thickness for the forward and rearward walls in comparison to the lateral sidewalls are as follows. A force downward F applied to boom 10 as described earlier herein will result in a force (e.g. a bending moment) being applied to mast 100 and tube 110 thereof, that will primarily act on forward wall 111 and rearward wall 121 of tube 110. Specifically, such a bending moment may exert a compressive force on forward wall 111 and a tensile force on rearward wall 121, with a neutral axis lying therebetween (roughly even with the forward-rearward centerline $C_{f\text{-}r}$ as shown in FIG. 4) at which the forces are significantly lower.

The arrangements disclosed herein can increase the amount of material (e.g. aluminum) that is positioned further away, along forward-rearward axis $A_{f\text{-}r}$ from the neutral axis of tube 110, e.g. in comparison to a generic, circular mast/tube of the type shown in FIG. 3. Providing more of the material of the forward and rearward walls at a greater distance outward from the neutral axis will allow tube 110 to better resist the forces transmitted by boom 10. In contrast, lateral sidewalls 131 and 141 play a lesser role in resisting such forces; therefore there is little or no need to position the material of these sidewalls farther outward along the lateral axis $A_l$. In fact, the amount of material present in the sidewalls may be reduced in comparison to the amount of material present in the forward and rearward walls, as evident from the exemplary design of FIG. 4. It is noted in passing that any depressions or through-apertures that may be desired to be provided in mast 100, may be preferentially located in lateral sidewalls 131 and/or 141 of tube 110 (as in the case of through-apertures 105 shown in FIG. 1), where their presence will have less impact on the ability of tube 110 to bear forces transmitted by boom 10.

The arrangements disclosed herein thus allow enhancement of the ability of a tube (e.g. an aluminum tube) 110, mast 100, and davit 1 to withstand large forces, while minimizing any increase in the weight of tube 110 and thus of mast 100 and davit 1 as a whole. Such arrangements may be quantified in terms of the percent of the total mass of tube 110 that is provided by the forward and rearward walls, in comparison to the percent provided by the lateral sidewalls. In various embodiments the forward and rearward walls collectively provide at least 55, 60, 65, 70, 75, or 80% of the total mass of the tube; in further embodiments the left and right lateral sidewalls collectively provide no more than 45, 40, 35, 30, 25, or 20% of the total mass of the tube.

As shown in exemplary manner in FIG. 4, in some embodiments forward wall 111 and/or rearward wall 121 of tube 110 may be provided with a maximum wall thickness that is greater than the maximum wall thickness of the lateral sidewalls, by providing the wall(s) with at least one integral boss that protrudes radially inward. For example, forward wall 111 may comprise an arcuate, circumferentially-extending forward base 109 with a first end that is integrally connected to left lateral sidewall 131 at junction 118 and with a second end that is integrally connected to right lateral sidewall 141 at junction 118'. Rearward wall 121 may similarly comprise an arcuate, circumferentially-extending rearward base 139 with a first end that is integrally connected to left lateral sidewall 131 at junction 128 and with a second end that is integrally connected to right lateral sidewall 141 at junction 128'. Forward wall 111 may be provided with at least one boss 112 that integrally protrudes radially inward (and generally rearward) from forward base 109; rearward wall 121 may be similarly provided with at least one boss 122 that integrally protrudes radially inward (and generally forward) from rearward base 139. In various embodiments, any such boss may protrude radially inward to provide a local wall thickness (a total wall thickness, counting both the thickness of the boss and of the wall base from which the boss protrudes radially inwardly, e.g. thickness $T_{fw}$ of forward wall 111 of FIG. 4) that is greater than the wall thickness of areas of that wall that do not comprise a boss, by a factor of at least about 1.2, 1.6, 2.0, or 2.4. In further embodiments such a factor may be at most about 4.0, 3.5, 3.0, 2.5, or 2.1. In various embodiments a local (total) wall thickness in an area comprising a boss may be at least about 4/16, 5/16, 6/16, 7/16, 8/16, 9/16, or 10/16 of an inch and may be at most about 12/16, 11/16, 10/16, 9/16, 8/16 or 7/16 of an inch. In various embodiments a local wall thickness in an area not comprising a boss may be at least about 2/16, 3/16, 4/16 or 5/16 of an inch and may be at most about 8/16, 7/16, 6/16, 5/16 or 4/16 of an inch. A wall area comprising a boss may exhibit an aspect ratio (meaning the ratio of the maximum total wall thickness to the width of the boss) of at least about 1.2, 1.4, 1.6, or 1.8, and at most about 2.3, 2.1, 1.9, 1.7, 1.5, or 1.3. For obtaining such ratios in the case of a boss that exhibits tapered sidewalls as in FIGS. 4 and 5, an average width, taken at a point halfway along the radially inward-outward "height" of the boss, can be used.

Any such boss may extend circumferentially along the radially inward side of the base from which the boss protrudes, through any desired angular arc. (By way of a specific example, bosses 112 and 122 of FIG. 4 each extend through an angular arc that is in the range of approximately 30-40 degrees.) In various embodiments, such an arc (measured from a vertex at the geometric centerpoint of the tube) may be e.g. at least about 10, 20, 30, 40, 50, 60, 70, or 80 degrees. In further embodiments, such an arc may be at most about 90, 85, 75, 65, 55, 45, 35, 25, or 15 degrees.

Any such boss may comprise a convex corner 157 (as shown in exemplary embodiment in FIG. 4) that may be filleted (rounded) to any suitable radius of curvature, e.g. to reduce stress concentration during use of davit 1. In various embodiments, such a convex corner may exhibit a radius of curvature (when viewed along the long axis of the tube) of at least about 10, 30, 50, 70, or 90 thousandths of an inch, and of at most about 100, 80, 60, 40, or 20 thousandths of an inch. Any such boss may comprise a concave corner 158 (also as shown in exemplary embodiment in FIG. 4) that may be filleted to any suitable radius of curvature. In various embodiments, such a concave corner may exhibit a radius of curvature (when viewed along the long axis of the tube) of at least about 30, 60, 90, 120, or 150 thousandths of an inch, and of at most about 160, 130, 100, 70, or 40 thousandths of an inch. As noted above, in some embodiments a boss may be tapered, e.g. to any desired extent. In at least some such cases, the two sidewalls of a boss may exhibit a taper angle. This angle may be found by extrapolating the sidewalls radially inwardly to a common intersection point which serves as a vertex for determining the taper angle. By way of specific examples, exemplary boss 112 of FIG. 4 exhibits a taper angle in the range of approximately 55-60 degrees; exemplary boss 112 (tooth 115) of FIG. 5 exhibits a taper angle in the range of approximately 25-30 degrees. In various embodiments, any such boss may exhibit a taper angle that is at least about 10, 20, 30, 40 or 50 degrees; in further embodiments such an angle may be at most about 85, 65, 45, 35, 25, or 15 degrees. In some embodiments, the lateral centerline $C_l$ of tube 110 may pass through a boss; e.g. the boss may be laterally centered so that the lateral centerline bisects the boss. For example, in the exemplary design of FIG. 4, the lateral centerline $C_l$ of the tube passes through (and bisects) both forward boss 112 and rearward boss 122.

Figure 5:
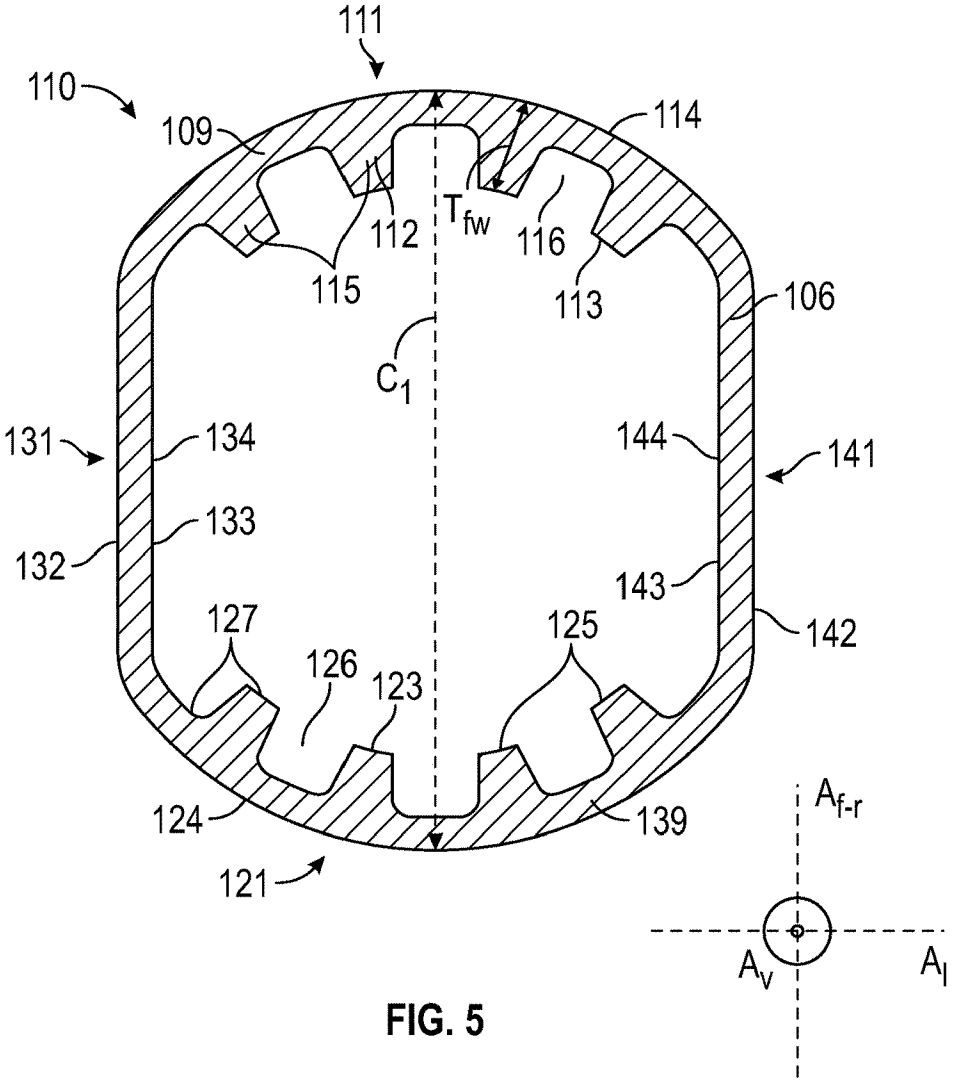
FIG. 5 is a cross-sectional top view of another exemplary tube of a mast of a davit.

In some embodiments, the at least one boss 112 of forward wall 111 of tube 110 may take the form of at least two radially-inwardly-protruding teeth 115 that are circumferentially spaced along at least a portion of a circumferential extent of a radially inward side of forward base 109 of forward wall 111, as shown in exemplary embodiment in FIG. 5. Spaces (gaps) 116 may thus be present between neighboring teeth 115. Similarly, the at least one boss 122 of rearward wall 121 may take the form of at least two radially-inwardly-protruding teeth 125 that are circumferentially spaced along at least a portion of a circumferential extent of a radially inward side of rearward base 139 of rearward wall 121 (also as shown in exemplary embodiment in FIG. 5), with spaces 126 being present between neighboring teeth 125.

At least some such forward teeth 115 may protrude at least generally rearward, and/or at least some such rearward teeth 125 may protrude at least generally forward. Forward teeth 115 and rearward teeth 125 may be present in any desired number; for example, two, three, four (as in the exemplary design of FIG. 5), five, six, or more. In some embodiments the forward and rearward teeth may be present in the same number and may be provided at corresponding locations (both as in the arrangement of FIG. 5). Or, the forward and rearward teeth may differ in number and/or location (for example, a design might comprise four forward teeth and three rearward teeth), it being understood that such designs may not exhibit the $2^{nd}$-order rotational symmetry mentioned above. In some embodiments, the lateral centerline $C_l$ of tube 110 may pass through a space between two neighboring teeth (e.g. as in FIG. 5). The teeth may be uniformly spaced along the circumferential extent of a wall; or, the teeth spacing may vary. In various embodiments, the teeth may be spaced such that the average width of a gap 116 or 126 between neighboring teeth is at least 100, 120, or 140 percent of the average width of the neighboring teeth that define the gap. In various embodiments, the radially-inward surfaces of wall areas that underlie gaps 116 and 126 may be e.g. at least generally planar (e.g. as in FIG. 5) or may be slightly arcuate e.g. so that they are locally parallel to the radially-outward surfaces 114 and 124. In some embodiments, neighboring teeth 115 and/or 125 may be near enough to each other, and/or may comprise concave corners with sufficiently large radii of curvature, that the bases of the neighboring teeth may approach each other and/or blend smoothly into each other e.g. along an arcuate path (rather than being separated from each other by a generally flat area as in the exemplary design of FIG. 5). In some embodiments each boss may comprise sidewalls that are at least generally planar along a majority of the radially inward-outward "height" of the boss (as in the exemplary embodiment of FIG. 5). In other embodiments, at least some portion, or the entirety, of any such sidewall may be arcuate, e.g. convex. (As noted above, any such sidewall may originate from a concave corner and/or may terminate in a convex corner, either of which may be radiused to any desired extent.)

Figure 6:
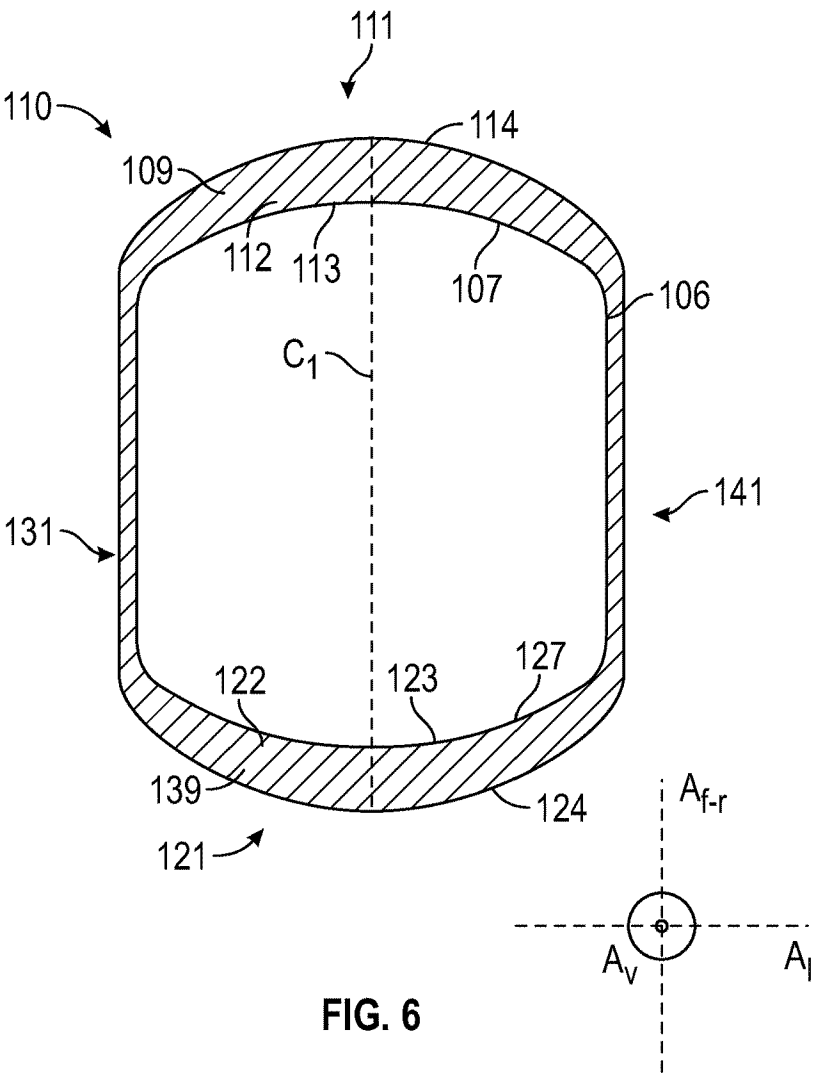
FIG. 6 is a cross-sectional top view of another exemplary tube of a mast of a davit.
Figure 7:
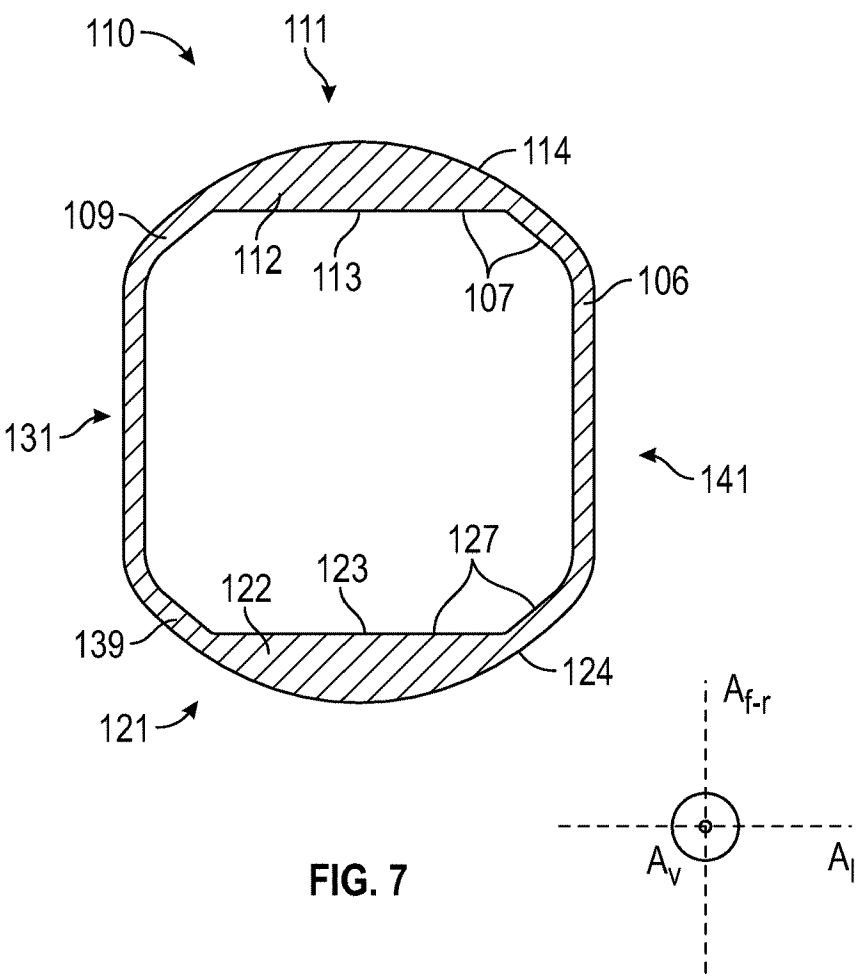
FIG. 7 is a cross-sectional top view of another exemplary tube of a mast of a davit.

The above discussions have concerned achieving a maximum forward wall thickness that is greater than that of lateral sidewalls, e.g. by providing a forward wall with at least one boss that protrudes radially inward from a forward base of the wall. It will be appreciated that many designs other than the specific exemplary designs of FIGS. 4 and 5 can achieve such effects. For example, FIG. 6 depicts an exemplary embodiment in which a single, radially-inwardly-protruding boss 112 is provided that circumferentially extends along essentially the entire circumferential extent of forward wall 111. In this case, the total wall thickness varies smoothly over the entire circumferential extent of the wall and boss, reaching a maximum at the lateral centerline $C_l$; also, the radially inwardmost surface 113 of boss 112 exhibits a smoothly arcuate appearance. In another variation, FIG. 7 depicts an exemplary embodiment in which boss 112 of forward wall 111 exhibits a radially inward major surface that is at least generally planar (rather than arcuate as in the design of FIG. 6) and that is at least generally aligned with the lateral axis $A_l$ of the tube. In the FIG. 7 design the wall thickness varies over a portion of the circumferential extent of forward wall 111, reaching a maximum at the lateral centerline.

Figure 8:
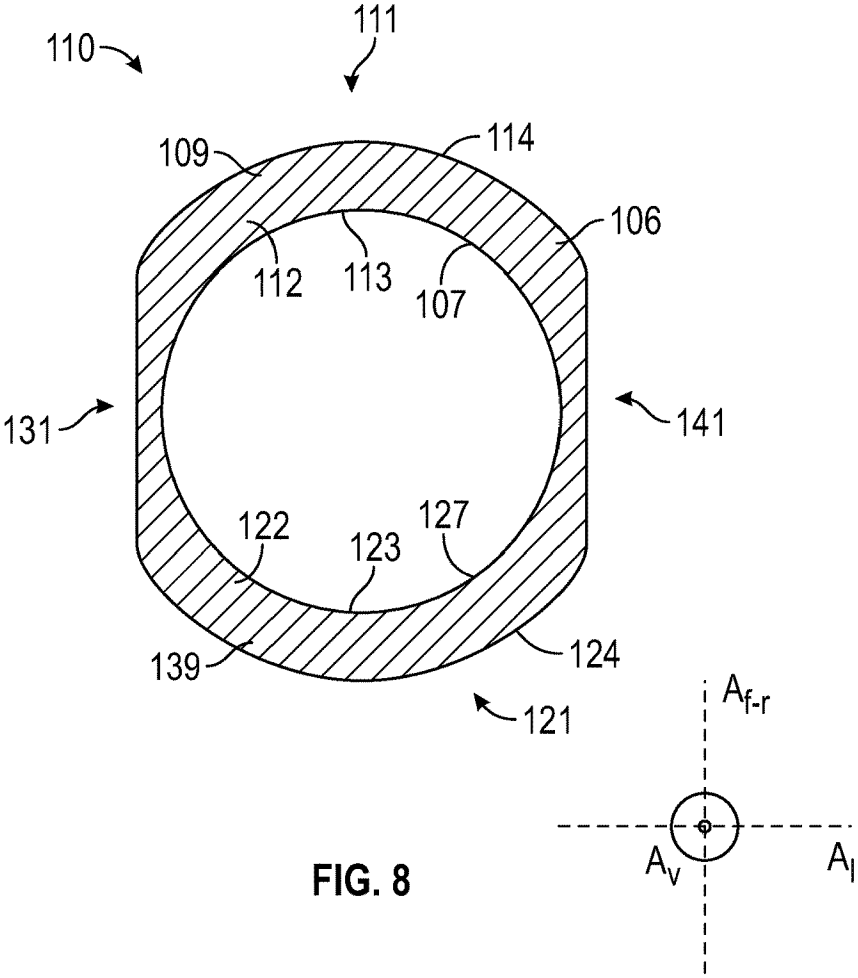
FIG. 8 is a cross-sectional top view of another exemplary tube of a mast of a davit.
Figure 10:
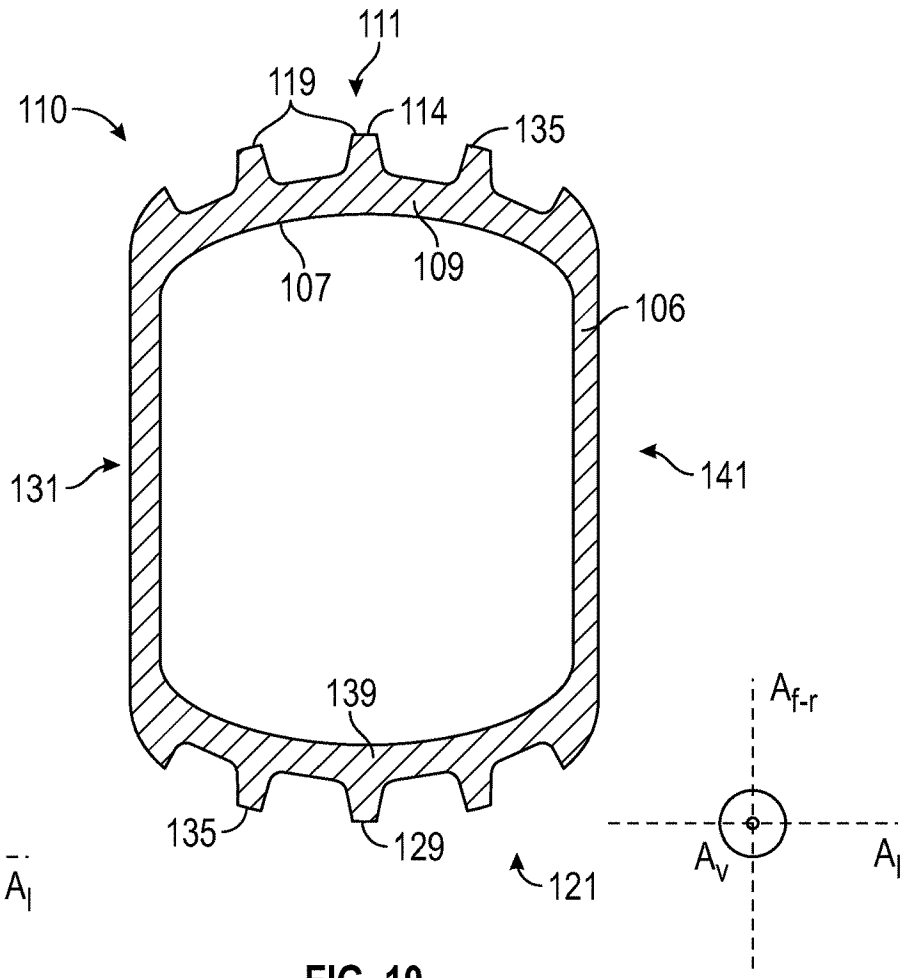
FIG. 10 is a cross-sectional top view of another exemplary tube of a mast of a davit.
Figure 9:
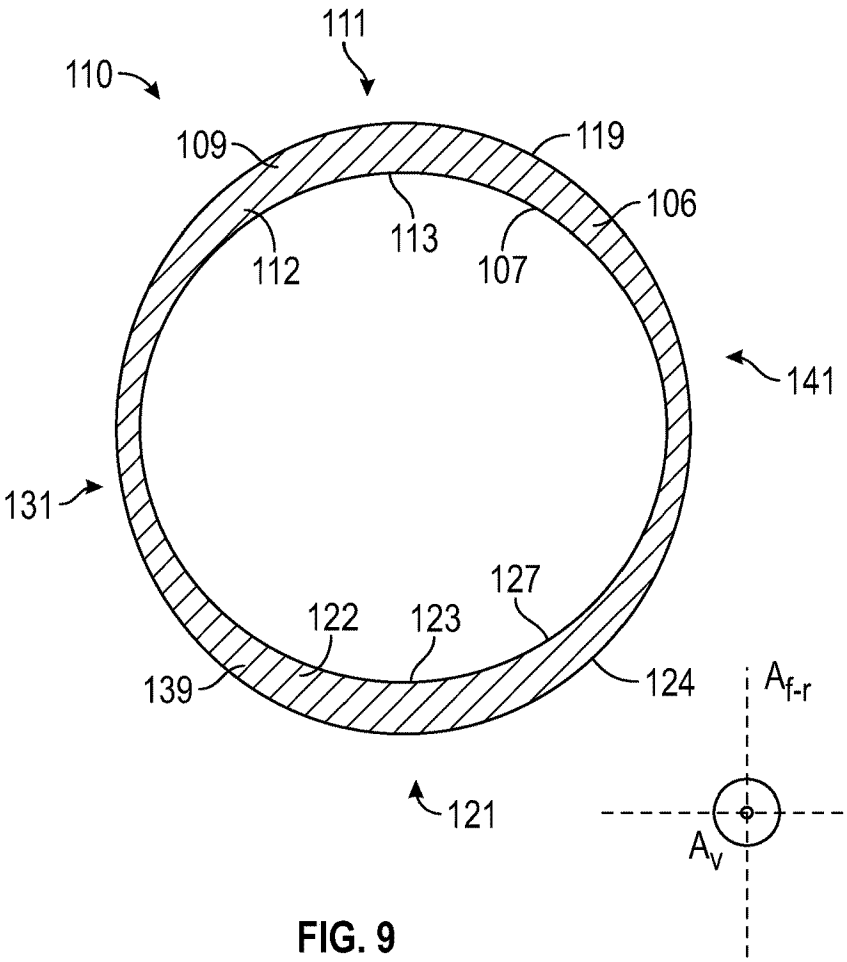
FIG. 9 is a cross-sectional top view of another exemplary tube of a mast of a davit.

FIGS. 8 and 9 illustrate additional exemplary arrangements in which tube 110 is elongated along its forward-rearward axis and exhibits a maximum thickness of the forward wall, and of the rearward wall, that is greater than that of the lateral sidewalls. FIG. 10 depicts still another exemplary arrangement, in which at least one boss 135 is provided that extends radially outwardly from a base 109 of forward wall 111 and at least one boss 135 is provided that extends radially outwardly from a base 139 of rearward wall 121. In the depicted embodiment, the at least one radially outwardly-protruding boss 135 takes the form of radially-outwardly protruding forward teeth 119 and rearward teeth 129. It will be appreciated all such arrangements fall within the general category of providing a tube that is elongated in the forward-rearward direction and that exhibits a maximum wall thickness of the forward wall (and of the rearward wall), that is greater than a maximum wall thickness of the lateral sidewalls.

Figure 11:
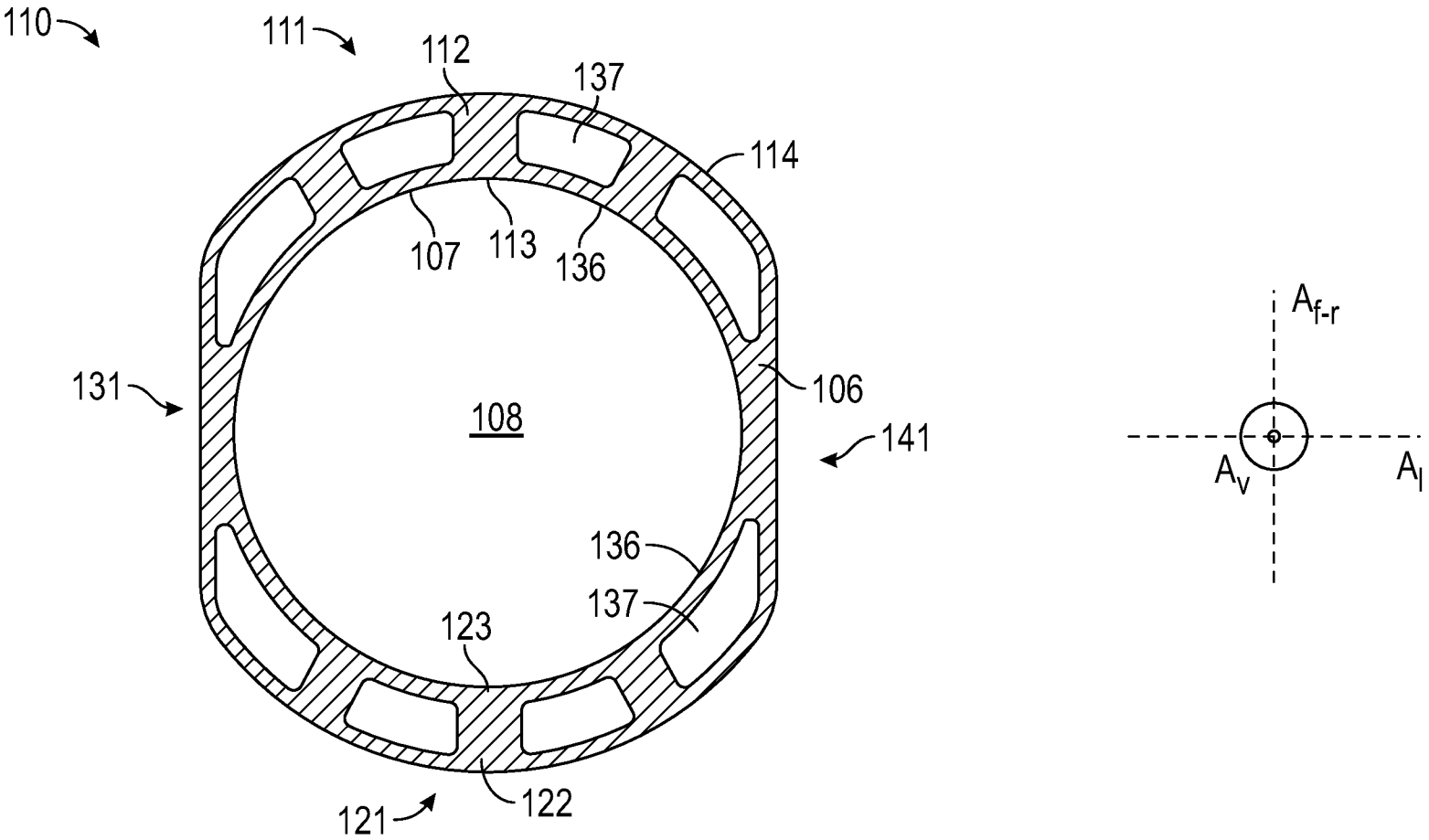
FIG. 11 is a cross-sectional top view of another exemplary tube of a mast of a davit.

Still another exemplary embodiment is illustrated in FIG. 11. In this embodiment, an integral flange 136 is provided that is positioned radially inwardly of bosses 112 of forward wall 111 and is positioned radially inwardly of bosses 122 of rearward wall 121. In the particular design of FIG. 11, integral flange 136 extends circumferentially to form a complete circle (with outward surfaces that are in contact with lateral sidewalls 131 and 141). However, in other embodiments, such a flange may e.g. only extend between selected bosses of forward wall 111 and/or between selected bosses of rearward wall 121. In other words, in some embodiments such a flange may only occupy a forward arc and a rearward arc, rather then forming a complete circle.

It will be apparent that any such a design may provide "closed" cavities 137, by which is meant elongate cavities that extend the length of tube 110, that are closed off in the radially inward and outward directions and in the circumferential direction of the tube, and whose only openings are at the terminal ends of the elongate length of the tube. In other embodiments, tube 110 may be a "solid-wall" construction (e.g. as in the exemplary designs of FIGS. 4-10), meaning that no such closed cavities are present, other than interior space 108 that is collectively radially enclosed by the forward, rearward and lateral tube walls in combination.

Figure 12:
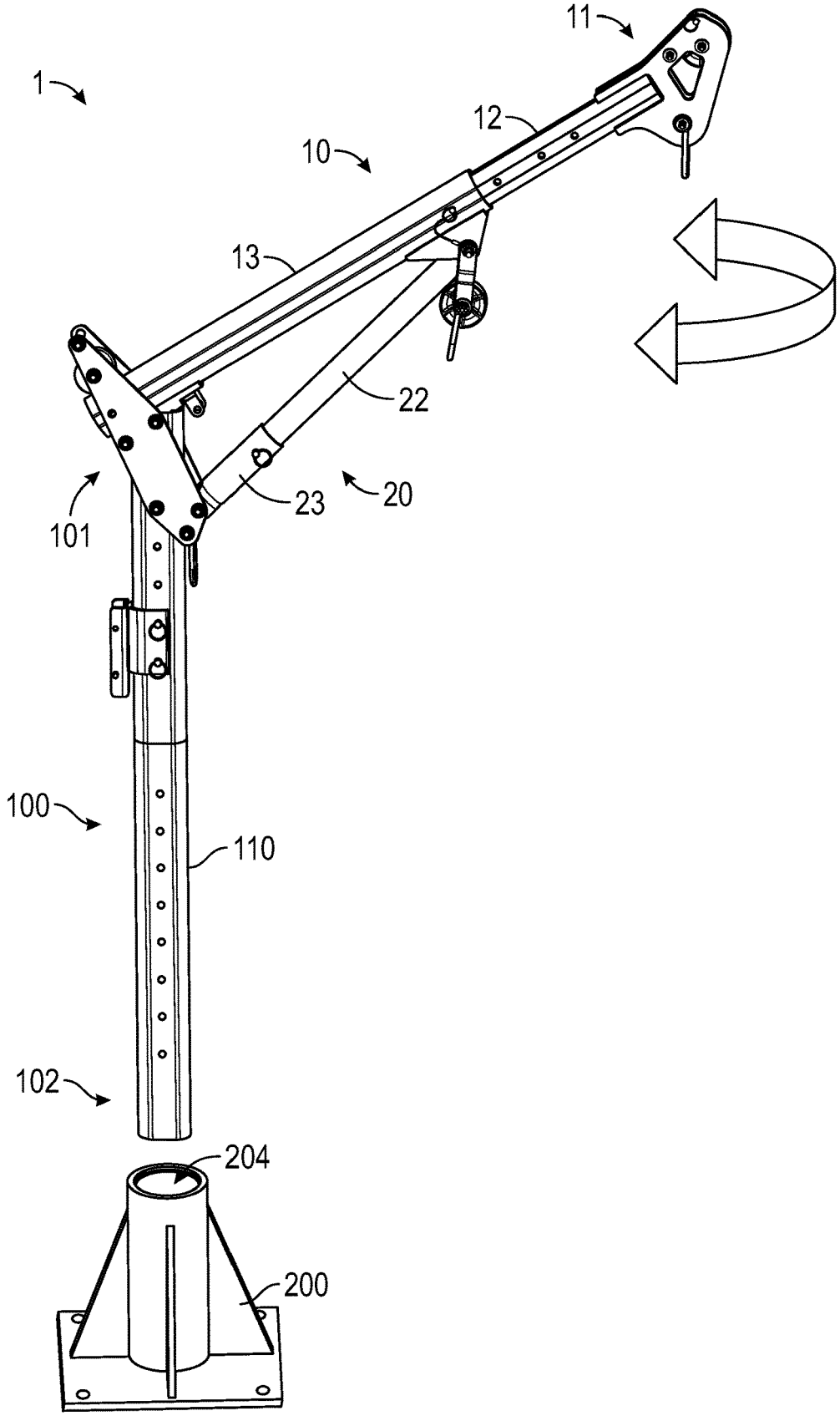
FIG. 12 is a side view of an exemplary confined-space davit, shown exploded away from a support base in which the lower end of the mast of the davit is inserted.
Figure 13:
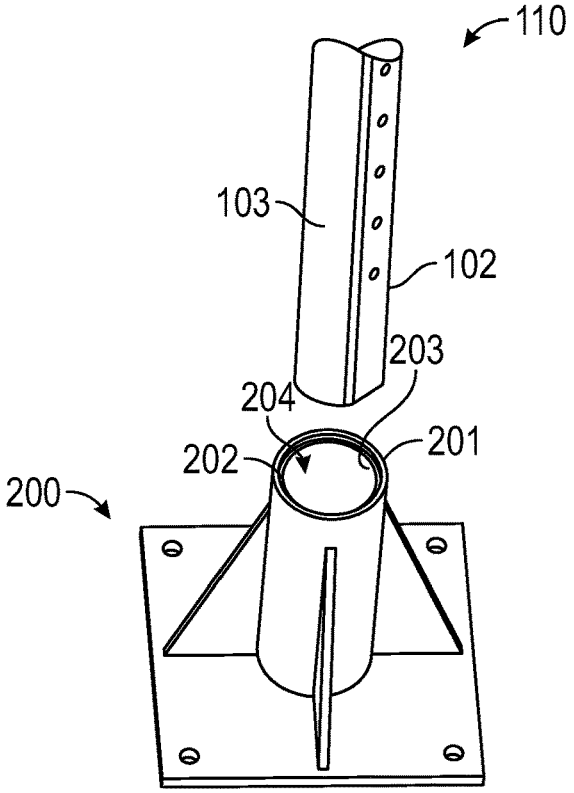
FIG. 13 is an isolated, magnified view of the lower end of the mast and the support base, of FIG. 12.

It will be noted that the exemplary designs of FIGS. 4-11 exhibit certain commonalities. In particular, not only is tube 110 elongated in the forward-rearward direction, the radially outward surfaces of forward wall 111 and rearward wall 121 follow an arcuate path that is specifically configured as described below. This can be done in order to provide a functionality that is useful for confined-space davits. Specifically, it is desirable that a davit 1 be able to rotate about an axis of rotation coincident with the vertical axis of the davit mast 100, as indicated by the arcuate block arrow in FIG. 1. This is conveniently provided by seating the lower end portion 102 of mast 100 (i.e., of tube 110) into a cavity 204 defined within a support base 200, as shown in FIG. 12 (in which the lower end portion 102 of tube 110/mast 100 is shown exploded away from of the base so that details of the base can be seen). In some convenient arrangements, such a base 200 (which is typically made of metal, e.g. steel) can comprise a sleeve 201 that accepts a bushing 202 whose radially-inward surface 203 defines a cylindrical, upwardly-open-ended cavity 204, as shown in the isolated magnified view of FIG. 13. Such a bushing may be made of any convenient material (e.g. PVC plastic or any material with a relatively low coefficient of friction) that enhances the ability of lower end portion 102 of mast 100 to rotate relative to base 200. (If desired, the bushing may be bonded, e.g. adhesively bonded, to sleeve 201 of base 200.)

Such arrangements allow davit 1 as a whole, including both mast 100 and boom 10, to rotate relative to base 200. This allows that e.g. if davit 1 is used to raise a worker out of a confined space (whose entry is directly under boomhead 11, in the usual positioning of davit 1), after the worker is raised vertically out of the confined-space entry the davit can then be rotated so that the worker is no longer positioned directly over the confined-space entry. The worker can then be detached from the davit cable.

Thus, it is advantageous that davit 1, e.g. mast 100 and tube 110 thereof, be configured to be rotatable with respect to a base 200 in which the lower end portion 102 of mast 100 (and of tube 110) is inserted. Thus, as shown in exemplary embodiment in FIG. 14, which is a top, cross-sectional view taken along the vertical axis of tube 110, the radially outward major surfaces 114 and 124 of forward and rearward walls 111 and 121 may be configured to allow this. Thus in at least some embodiments, radially outerwardmost portions of radially outward (forward) surface 114 of forward wall 111 of tube 110 will collectively define a forward arc (as evident in FIG. 4). Radially outerwardmost portions of a rearward surface 124 of rearward wall 121 of tube 110 will collectively define a rearward arc. As shown in exemplary embodiment in FIG. 4, these surface portions can be configured so that both the forward arc and the rearward arc lie on a common circle ($C_c$) with a common center and a common radius of curvature. These arcs are configured so that this common circle will fall outside at least some portions of radially outward major surfaces 132 and 142 of left and right opposing lateral sidewalls 131 and 141 of tube 110, as evident from FIG. 4. In various embodiments these arcs may be configured so that this common circle will fall outside at least about 30, 40, 50, 60, 70, 80, 90, or 95% of the circumferential extent of major surfaces 132 and 142 of opposing sidewalls 131 and 141. In at least some embodiments, no portion of the left or right lateral sidewall will extend radially outward beyond this common circle.

Figure 14:
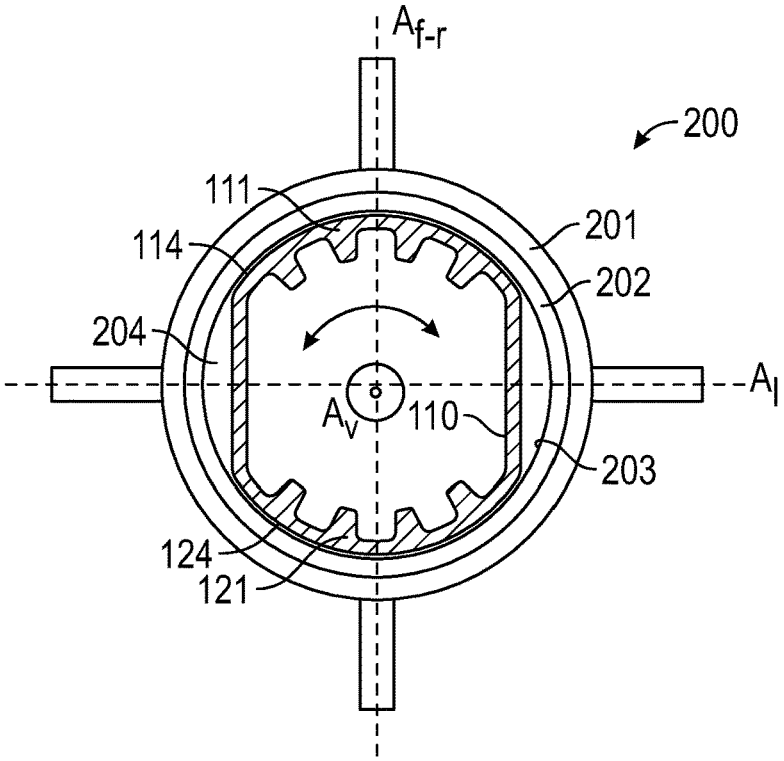
FIG. 14 is a top cross-sectional view of a lower end of a mast as inserted into a support base.

As can be seen from inspection of FIG. 14, such arrangements can provide that the arcuate radially-outward surfaces 114 and 124 of forward and rearward walls 111 and 121 of tube 110 can fit snugly within a cavity 204 of a support base 200, so that davit 1 can be securely supported and held by the base but while allowing tube 110, and thus mast 100 and davit 1 as a whole, to be rotated relative to the base. In other words, the present work has shown that it is not necessary for the radially outwardmost surfaces of tube 110 to take the form of a full, uninterrupted circle, in order for the tube to be held in a rotatable manner within a circular cavity 204 of a base 200. That is, the present disclosures allow a tube of a mast to be e.g. elongated in the forward-rearward direction to achieve the advantages detailed earlier herein, but to nevertheless be able to fit into, and rotate within, a circular cavity of a support base. In various embodiments the forward and rearward arcs may collectively occupy at least about 160, 180, 200 or 220 degrees of the common circle $C_c$. In further embodiments the forward and rearward arcs may collectively occupy at most about 230, 210, 190 or 170 degrees of the common circle. In some embodiments, the forward and rearward arcs may lie on a common circle that comprises a diameter of from at least about 3.6, 3.8, or 4.0 inches, to at most about 4.3 or 4.1 inches.

Figure 15:
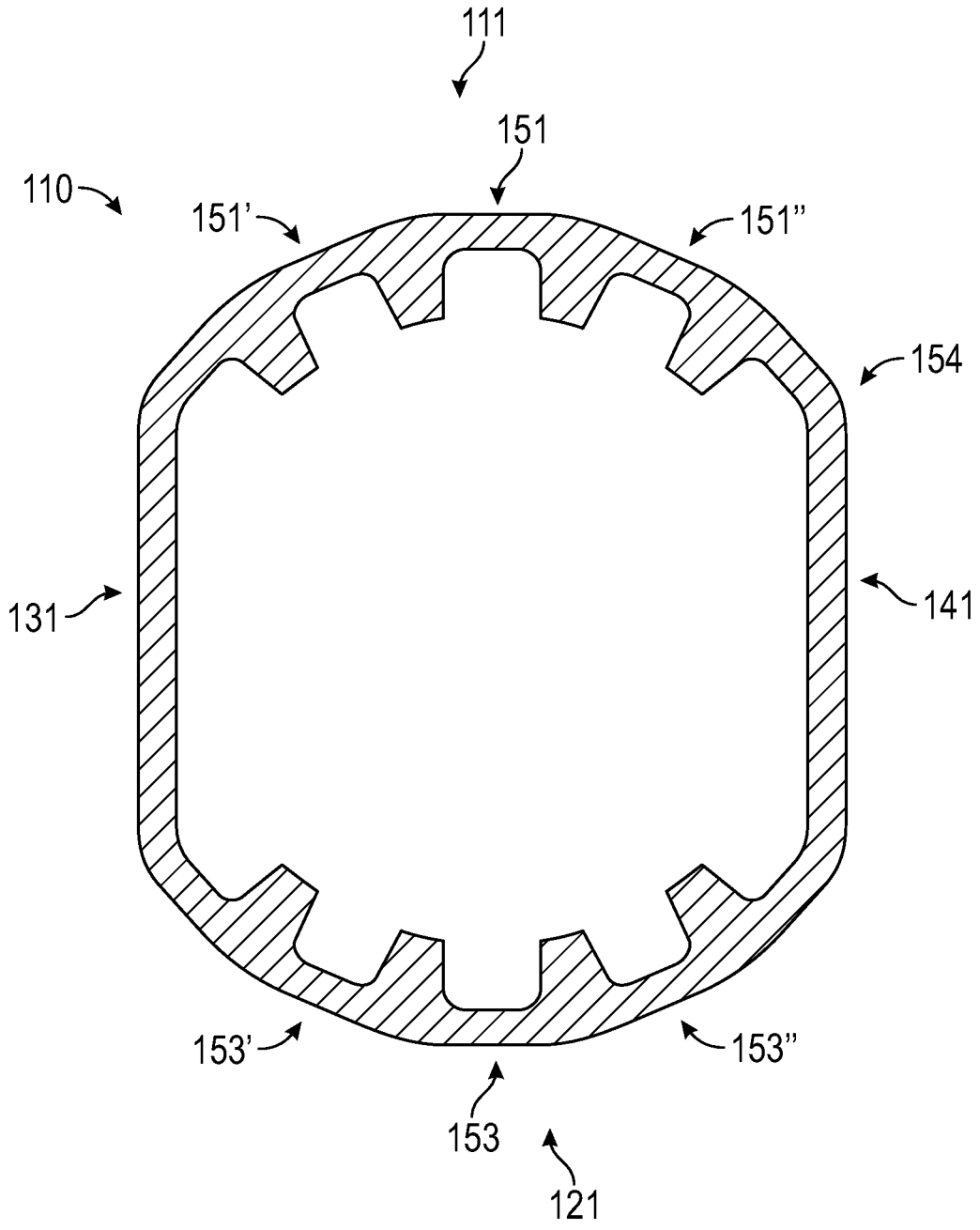
FIG. 15 is a cross-sectional top view of another exemplary tube of a mast of a davit.

In some embodiments, at least generally, substantially, or essentially all of the circumferential extent of radially-outward major surface 114 of forward wall 111, and/or of radially-outward major surface 124 of rearward wall 121, may be smoothly and uninterruptedly arcuate, e.g. as in the exemplary designs of FIGS. 4 and 5. However, in some embodiments, either or both of these outer surfaces may comprise at one, two, or more flat (planar) sections, as shown in exemplary embodiment in FIG. 15. In the particular arrangement of FIG. 15, forward surface 114 comprises flat sections (e.g. 151, 151' and 151") interspersed with arcuate sections; rearward surface similarly comprises flat sections (e.g. 153, 153' and 153"), again interspersed with arcuate sections. In other embodiments, one or more e.g. quasi-flat sections that are e.g. textured, furrowed, or the like may be present. Any such arrangements are permitted as long as at least some radially outerwardmost portions of the forward surface of the forward wall of the tube collectively define a forward arc and at least some radially outerwardmost portions of the rearward surface of the rearward wall of the tube collectively define a rearward arc with the arcs having properties as discussed above. In various embodiments the arc-defining sections of a forward surface (or of a rearward surface) may occupy at least about 30, 50, 70, or 90% of the circumferential extent of the surface.

In various embodiments (e.g. as in FIGS. 4-8 and 10) left and right lateral sidewalls 131 and 141 may exhibit laterally outward surfaces 132 and 142 that are at least generally, substantially, or essentially planar (flat), e.g. along most or all of the extent of the sidewall. In other words, such surfaces may each occupy a chord of a common circle defined by the radially outward surfaces of the forward and rearward walls. It will be appreciated that such provisions can enhance the ease with which brackets (e.g. bracket 403 as seen in FIG. 1, which may support a winch or a self-retracting lifeline) or the like can be attached to the sidewalls of tube 110. In particular, if one or more through-apertures 105 are provided in tube 110, such through-apertures may be conveniently located in sidewalls with at least generally flat outer surfaces, which can e.g. render it easy to insert quick-connect/release pins, bolts, or the like into the through-apertures.

In certain embodiments (e.g. as in FIGS. 4-7 and 10) left and right lateral sidewalls 141 and 142 may exhibit laterally inward surfaces 133 and 143 that are at least generally, substantially, or essentially planar, e.g. along most or all of the circumferential extent of the sidewall. In some embodiments, both the laterally outwardmost and laterally inwardmost surfaces of the sidewalls may be planar. In some embodiments the left and right lateral sidewalls may each exhibit a wall thickness that is at least generally, substantially or essentially uniform, along at least 70, 80, 90, or 95% of the circumferential extent of the sidewalls (as shown in various aspects in FIGS. 4-7 and 10). In some such cases the circumferential extent along which the lateral wall thickness is uniform, may often be aligned with the forward-rearward axis of tube 110, e.g. as in the exemplary designs of FIGS. 4-7 and 10.

In various embodiments, an at least substantially planar portion of the laterally outwardmost major surface of each lateral sidewall (and/or a like portion of the laterally inwardmost surface of each lateral sidewall) may be aligned within plus or minus 10, 5, or 2 degrees of the forward-rearward axis of the tube. In some embodiments the laterally outwardmost major surface and/or the laterally inwardmost major surface of each lateral sidewall may exhibit surface texture while still exhibiting an overall major plane that is aligned e.g. within plus or minus 10 degrees of the forward-rearward axis of the tube. For example, any such surface may be slightly ridged, furrowed (e.g. in a direction along the long axis of tube 110), pebbled, or the like.

It will be appreciated that providing lateral sidewalls that are of relatively constant thickness and/or that comprise a radially inward and/or a radially outward major surface that is at least generally aligned with the forward-rearward axis of the tube, can allow the amount of material that is present in the lateral sidewalls to be minimized. This can reduce the weight of e.g. an aluminum tube 110 without significantly affecting the ability of the tube to resist the forces transmitted by the boom, according to the discussions earlier herein. In various embodiments, a lateral sidewall 131 or 141 of a tube 110 may exhibit a maximum wall thickness of at most about 0.15, 0.20, 0.25, or 0.30 inches. In various embodiments, a forward or rearward base 109 or 139, in areas not bearing a boss as described above, may exhibit a wall thickness that is within plus or minus 20, 10, or 5% of the maximum wall thickness of the lateral sidewalls. (An arrangement in which the wall thickness of forward and rearward bases 109 and 139 is approximately equal to the wall thickness of lateral sidewalls 131 and 141, is shown in exemplary embodiment in FIG. 5.) In various embodiments a forward or rearward wall 111 or 121 of tube 110 may, e.g. in areas bearing a boss, exhibit a thickness of at least about 0.30, 0.35, 0.40, 0.45, 0.50, 0.55, or 0.60 inches.

In many of the inventive designs presented herein an ordinary artisan will be able to readily distinguish a forward (or rearward) wall of a tube 110 from a lateral sidewall of the tube. For example, forward and rearward walls 111 and 121, and left and right lateral sidewalls 131 and 141, are identified in FIG. 4, with junctions 118 and 118' between forward wall 111 and the lateral sidewalls, and junctions 128 and 128' between rearward wall 121 and the lateral sidewalls, being further identified. That is, in many embodiments a demarcation between a lateral sidewall and a forward (or rearward) wall will be readily identifiable due to e.g. changes in wall thickness and/or in the orientation of the radially inward and outward surfaces of the walls. In some cases such as a design of the general type shown in FIG. 9, in which the changes in wall thickness and/or the orientation of the radially inner and outer surfaces may be rather gradual, an ordinary artisan will nevertheless be able to distinguish forward and rearward walls from lateral sidewalls. In various embodiments, the forward and rearward walls 111 and 121 of tube 110 may each respectively occupy an angular arc that is centered on the lateral centerline $C_l$ of the tube and that extends through a range of at least about 50, 70, 90, 110, or 130 degrees. In various embodiments, the forward and rearward walls of tube 110 may each respectively occupy an angular arc that is centered on the lateral centerline of the tube and that extends through a range of at most about 140, 120, 100, 80, or 60 degrees. In any event, for any tube as disclosed herein, it will be possible to ascertain the forward-rearward extent and the lateral width and ratios thereof, and to ascertain the maximum wall thickness of the various walls and ratios thereof, according to the procedures provided earlier herein.

In some embodiments, vertical, elongate mast 100 of davit 1 comprises a single tube (e.g. a monolithic annular extruded aluminum tube) 110 that provides the entire elongate length of the mast. For example, such a mast may take the form of a single tube that is e.g. 5 feet in length. However, in some embodiments, it may be desired that mast 100 is assembled from multiple tubes, e.g. to provide a mast of a desired height. For example, a 4 foot long first (lower) tube 170 may be used in combination with a 2 foot long second (upper) tube 160, in the general manner indicated in FIG. 16, to provide a mast with a total height of 6 feet. Thus in some embodiments, mast 100 may comprise at least first (170) and second (160) tubes (e.g. monolithic annular extruded aluminum tubes) 110 that are mated to each other in an end-to-end, longitudinally-aligned and rotationally-aligned manner. By this is meant that the tubes are mated with their long axes coinciding, and with a terminal end of upper end portion 171 of first, lower tube 170 abutting (e.g., contacting) a terminal end of lower end portion 161 of second, upper tube 160. By this is further meant that the tubes are aligned with each other when viewed along the vertical axis of the thus-formed mast (such that, for example, an inwardly-protruding boss of the lower tube is vertically aligned with that of the upper tube, the lateral sidewalls of the lower tube are vertically aligned with those of the upper tube, and so on). Any number (e.g. two, three, four, or five) of tubes may be aligned and mated (stacked) end-to-end in this manner, to form a mast 100.

Figure 16:
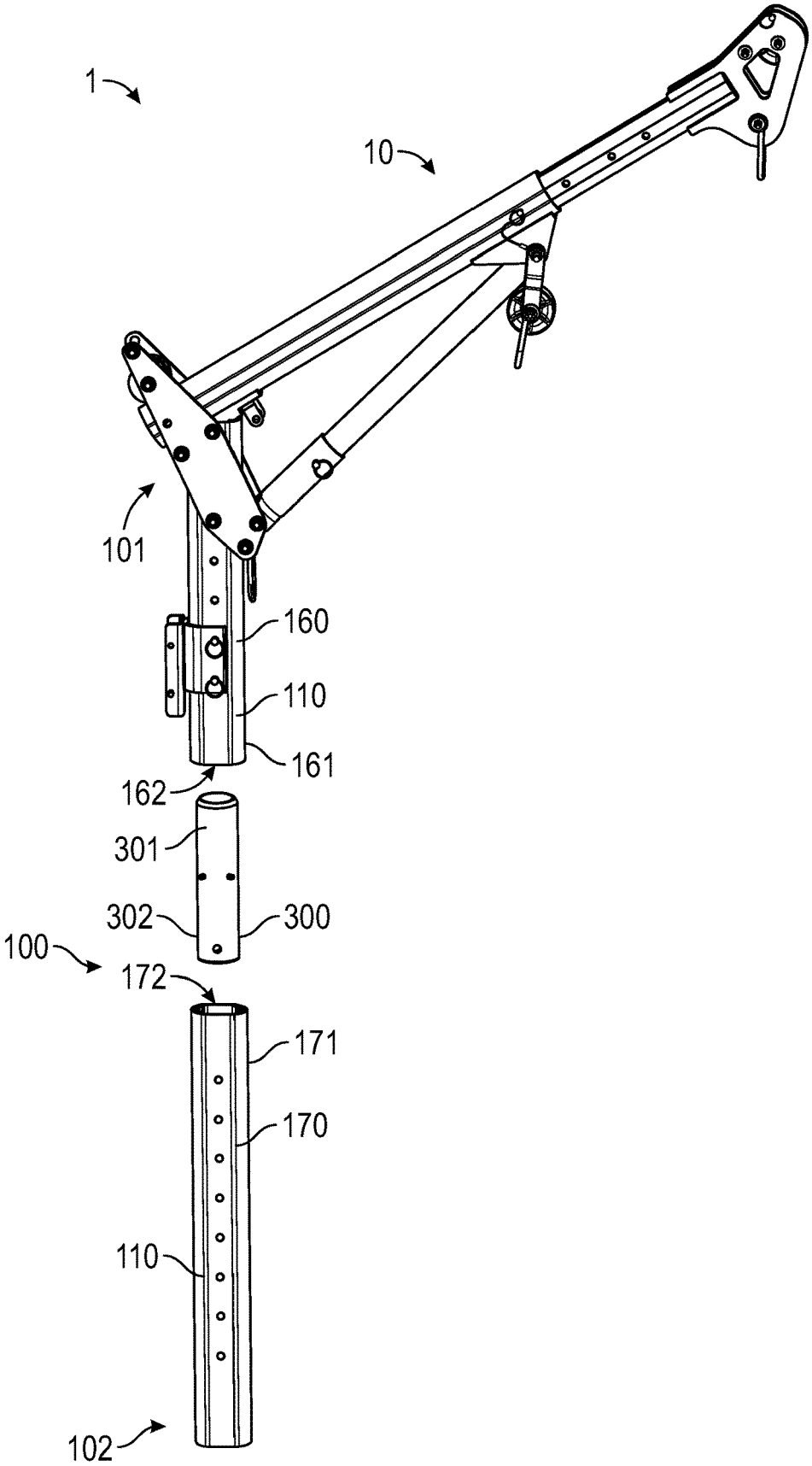
FIG. 16 is a side, partially exploded view of an exemplary confined-space davit in which the mast of the davit comprises multiple tubes that are mated together in end-to-end fashion and held in place by a coupler.
Figure 17:
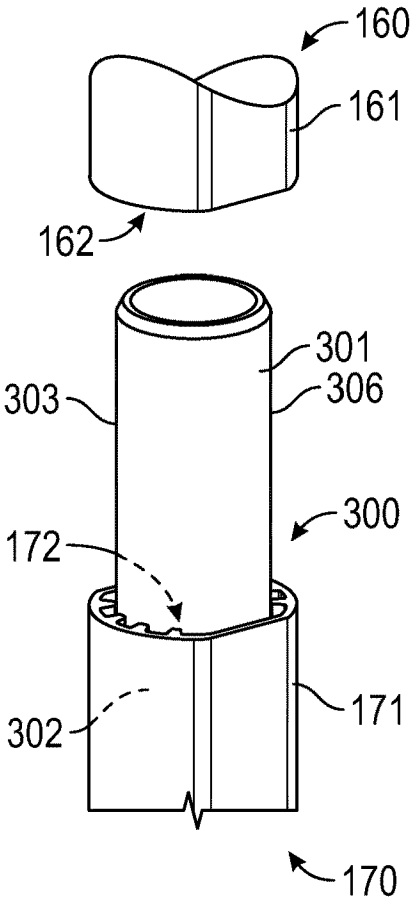
FIG. 17 is an isolated, magnified, partially exploded view of the end-to-end mated tubes and coupler of FIG. 16.

In such embodiments, each pair of end-to-end mated tubes may be held in place (i.e., with their terminal ends closely abutted against each other) by a coupler 300, as shown in exemplary embodiment in FIG. 16 and in the isolated magnified view of FIG. 17. Such a coupler 300 may exhibit an elongate shape (with a long axis that is aligned with long axis $A_v$ of the tubes that the coupler is used to mate to each other) with a lower portion 302 that is configured to fit into an interior receiving space 172 of an upper portion 171 of a first, lower tube 170. Coupler 300 may also comprise an upper portion 301 that is configured to fit into an interior receiving space 162 of a lower portion 161 of second, upper tube 160. (Each receiving space 162 and 172 is a part of interior space 108 within the mast 100 that is formed by coupling the tubes together.) Coupler 300 may be configured to fit snugly into these interior receiving spaces of the respective tubes, so that radially-outward surfaces 303 of coupler 300 closely abut the radially-inwardmost surfaces of the tubes. Coupler 300 may be held in position in any desired manner, e.g. by way of one or more fasteners (e.g., a solid cylindrical pin) that is inserted through an aligned set of through-apertures (e.g. of the type represented by apertures 105 as shown in FIG. 16) of the tube and that pass through an aligned set of complementary apertures in coupler 300. Such a fastener may be e.g. a quick connect/release pin that is retained in position e.g. by use of a cotter pin, an R-clip, or the like.

In some embodiments a coupler 300 may be installed into a tube in a permanent manner. For example, with reference to FIG. 16, a lower portion 302 of coupler 300 may be inserted into an interior receiving space 172 of an upper end portion 171 of a first, lower tube 170, and then may be permanently attached to first tube 170 e.g. by way of a permanent adhesive such as an epoxy, by welding or soldering, or by any suitably permanent mechanical fastener such as e.g. a rivet. An upper tube 160 may then be mated to lower tube 170 so that the upper portion 301 of coupler 300 is seated within a interior receiving space 162 of a lower portion 161 of the upper tube 160. If desired, upper tube 160 can be reversibly fastened to the upper portion 301 of the coupler, e.g. by the use of a mechanical fastener such as a pin as noted above. Desirably, any such mechanical fastener, if present, is easily unfastened so that mast 100 can be disassembled into its component tubes e.g. for transport to a different location when desired. In some embodiments no such mechanical fastener may be present; rather, upper tube 160 may be held in place atop lower tube 170 by its own weight in combination with the presence of coupler 300. As such, in some embodiments coupler 300 may primarily serve to hold the upper and lower tubes in place and to enhance the mechanical stability of the joint between upper tube 160 and lower tube 170, rather than serving to physically attach the upper and lower tubes to each other. A coupler 300 may comprise an elongate length that is chosen as desired to enhance the mechanical stability of a joint between end-to-end stacked tubes 100. A coupler 300 may be made of any suitable material, e.g. steel.

In embodiments in which a mast is provided by two or more end-to-end stacked tubes, it may be useful that the various tubes do not rotate relative to each other, in order to provide that any rotation of the boom will occur via rotation of the davit as a whole, i.e. by rotation of the lower end of mast 100 relative to base 200 in the above-described manner. Accordingly, in some embodiments a coupler 300 may comprise at least one anti-rotation feature that physically interferes with rotation of a first (e.g. a lower) tube relative to the coupler, and at least one anti-rotation feature that physically interferes with rotation of a second (e.g. an upper) tube relative to the coupler. Such anti-rotation features can combine to prevent the first tube and the second tube from rotating relative to each other. In the particular case that a coupler is permanently attached to a first tube (e.g. by way of a epoxy adhesive, a weld or solder, etc.) such an attachment will constitute an anti-rotation feature. However, even in such embodiments, an additional anti-rotation feature may be need to prevent rotation of the second tube (to which the coupler is not permanently attached) relative to the coupler.

In some embodiments an anti-rotation feature may be e.g. a pin that is passed through aligned apertures of the tube and of the coupler, in the manner described above. In some embodiments an anti-rotation feature may take the form of at least one boss 304 that protrudes radially outward from a main body 306 of the coupler, as shown in exemplary embodiment in FIG. 18. Such an arrangement can be particular useful in embodiments in which the tube comprises a set of radially inwardly-protruding bosses (e.g., teeth) with spaces therebetween (e.g., as in design shown in FIG. 4 and in FIG. 18). When the coupler and the tube are slidably mated together, the at least radially outwardly-protruding boss 304 of the coupler can slide into a space 116 between neighboring inwardly-protruding bosses (e.g. teeth) 115 of the tube in the general manner shown in FIG. 18, thus preventing rotation of the tube relative to the coupler. Such a radially-outwardly-protruding boss 304 of the coupler can take any suitable form, e.g. it may comprise one or more studs, pins or the like. In such a case, separate studs may be provided at separate locations along the elongate length (i.e., vertical height) of the coupler to prevent rotation of both the upper tube and the lower tube, relative to the coupler. In some embodiments (e.g. as in the exemplary design of FIG. 18) the coupler can be provided with at least one such anti-rotation boss that interacts with the forward wall of the tube, and at least one additional anti-rotation boss that interacts with the rearward wall of the tube.

Figure 19:
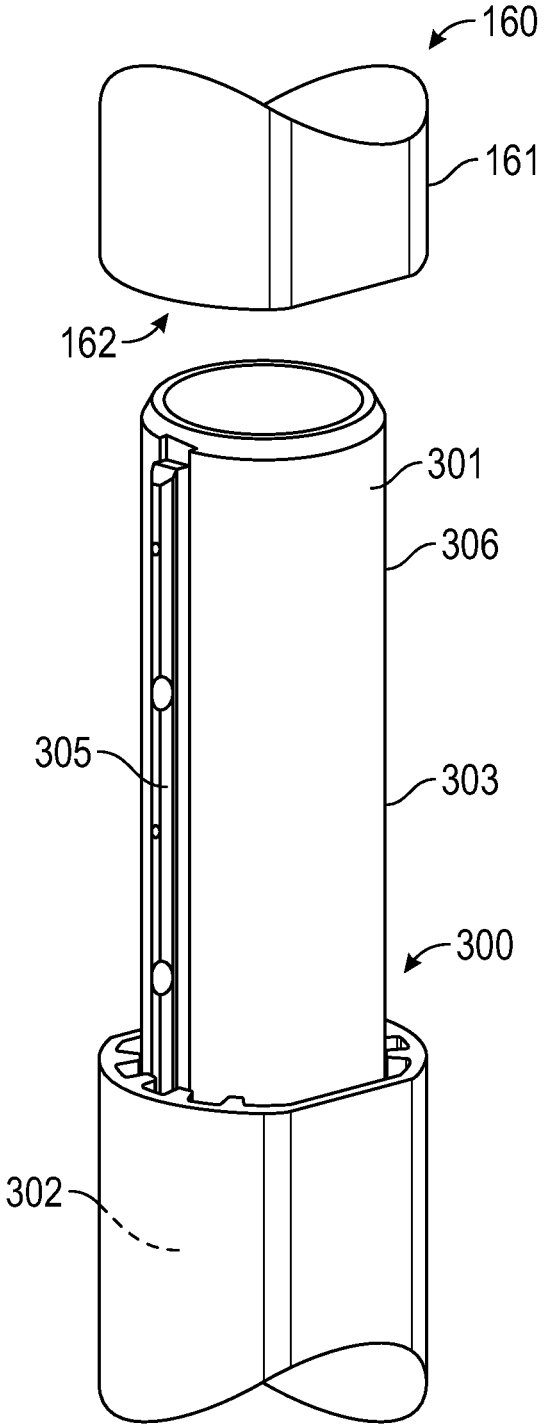
FIG. 19 is a side-rear view of a coupler as inserted into an end of a tube of a mast, the coupler comprising an anti-rotation feature in the form of an elongate spline.

In other embodiments, such a radially-outwardly-protruding boss 304 may take the form of one or more elongate splines (ridges) 305 that protrude radially outwardly from radially outward surface 303 of coupler 300 and that exhibit a long axis that is aligned with a long axis of the coupler, as shown in FIG. 19. While separate, vertically-spaced splines may be provided to interface with the upper and lower tubes, in many cases it may be convenient to provide one or more ridges splines that extend far enough along the long axis of the coupler that an upper portion of the spline interfaces with the upper tube and a lower portion of the same ridge, as in the exemplary design of FIG. 19.

It will be appreciated that in addition to providing an anti-rotation functionality, one or more elongate splines 305 that exhibit a long axis that is aligned with a long axis of coupler 300 may serve to further enhance the mechanical strength and resistance to bending of the joint between upper tube 160 and lower tube 170. In various embodiments, such a spline 305 may extend along at least about 60, 70, 80, 90, or 95% of the elongate length of coupler 300. In some embodiments, at least two such splines (e.g. one spline to interface with the forward wall of each tube, and an opposing spline to interface with the rearward wall of each tube) may be provided.

Any such boss, whether in the form of a pin, stud, spline, runner, etc., may be a separately-made piece that is attached to coupler 300; or, it may be an integral part of coupler 300, as desired.

Figure 18:
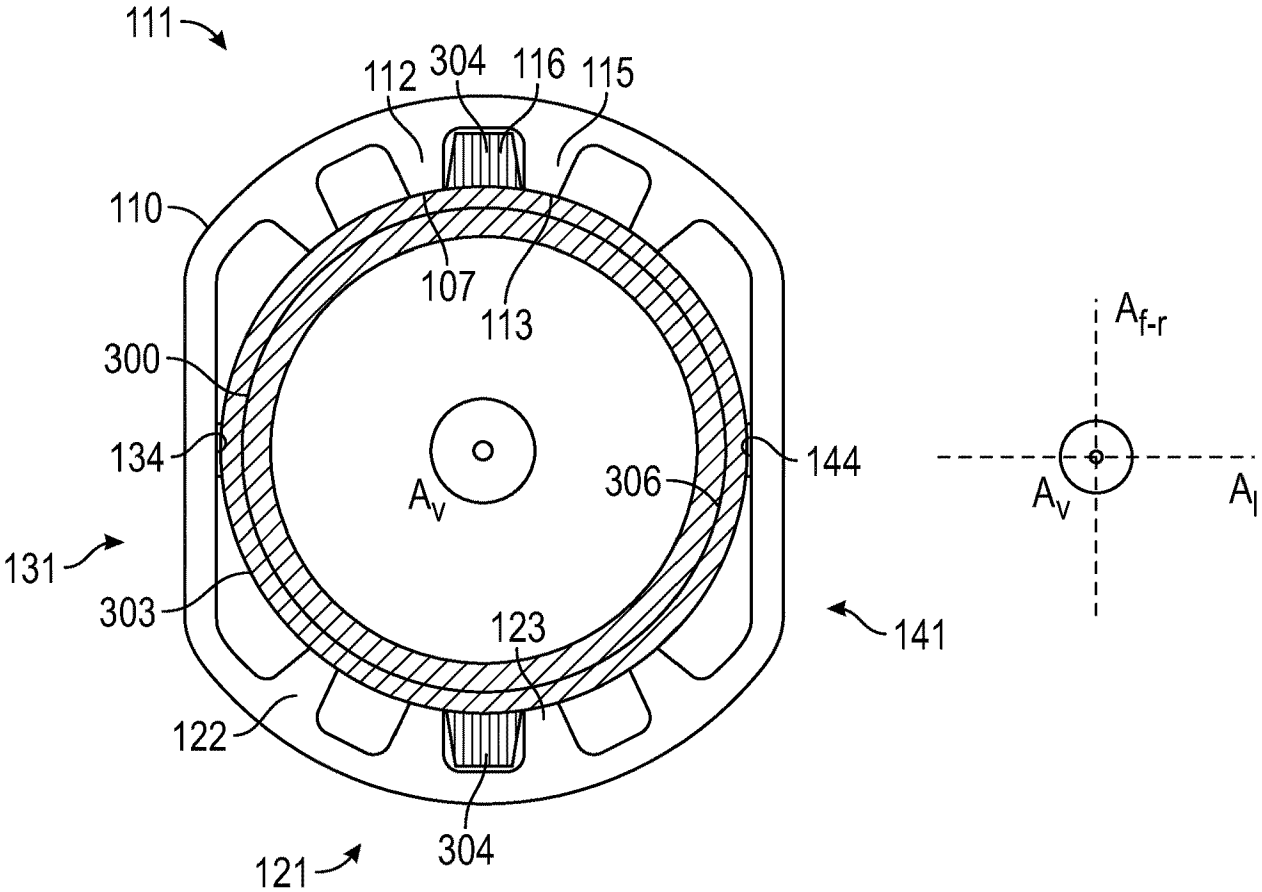
FIG. 18 is a top cross-sectional view of a coupler as inserted into an end of a tube of a mast, the coupler comprising an anti-rotation feature.

In some embodiments it may be desirable to configure the interior of a tube 110 so that a coupler that is at least generally circular in cross-section e.g. as shown in FIGS. 17-19, can fit snugly and securely within the interior space of tube 110. Such arrangements may enhance the ease with which the coupler may be slidably inserted into the interior space of the tube, particularly if the coupler comprises e.g. a radially-outwardly-protruding anti-rotation feature. Thus, in some embodiments, a tube 110 may be configured so that radially inwardmost portions 113 of radially inward surface 107 of forward wall 111 of tube 110 lie on a forward arc. (In many convenient embodiments, such as in FIG. 18, such radially inwardmost surface portions will be inward surfaces of bosses 112). The tube may be likewise configured so that radially inwardmost portions 123 of radially inward surface 127 of rearward wall 121 of tube 110 all lie on a rearward arc. The tube may be configured so that the forward and rearward arcs both lie on a common circle with a common center and a common radius of curvature, which common circle lies within a space between the radially inwardmost points (134 and 144) of the left and right lateral sidewalls, as illustrated in FIG. 18 (in which this common circle closely encircles radially outward surface 303 of main body 306 of coupler 300). Such arrangements can provide that coupler 300 can be held within the interior space of the tube tightly and securely. By way of a specific example, the forward and rearward arcs may lie on a common circle with a radius of 1.5 inches, so as to accept a coupler with an outside diameter of 3.0 inches.

In some embodiments, the radially inwardmost surface portions 113 and 123 of some or all of the bosses 112 and 122 may be arcuate (e.g. concave) so that most or all points on all of these surfaces lie at least substantially, or essentially, on one of the aforementioned forward and rearward arcs. In other words, in some embodiments the radially-inwardmost surfaces 113 and 123 of the tube bosses may be curved to very closely match the curvature of the radially-outerwardmost surfaces of the coupler. In other embodiments, inwardly-protruding bosses (e.g., teeth that are spaced apart along an arc) of the tube may be configured so that only some portions, e.g. the circumferential midpoints, of surfaces 113 and 123 of the bosses lie on these arcs. For example, any such bosses may comprise a radially-inward surface that is planar (flat) or is even convex. Such bosses may be configured (e.g. so that the angular offset between the radially-inward surfaces of any two adjacent bosses is less than a certain value (e.g., 30 degrees)), so that the set of bosses can still allow a circular coupler to be suitably held, even without the radially-inwardmost surfaces of the bosses being concave surfaces that "exactly" match the curvature of the radially-outward surface of the coupler.

Figure 20:
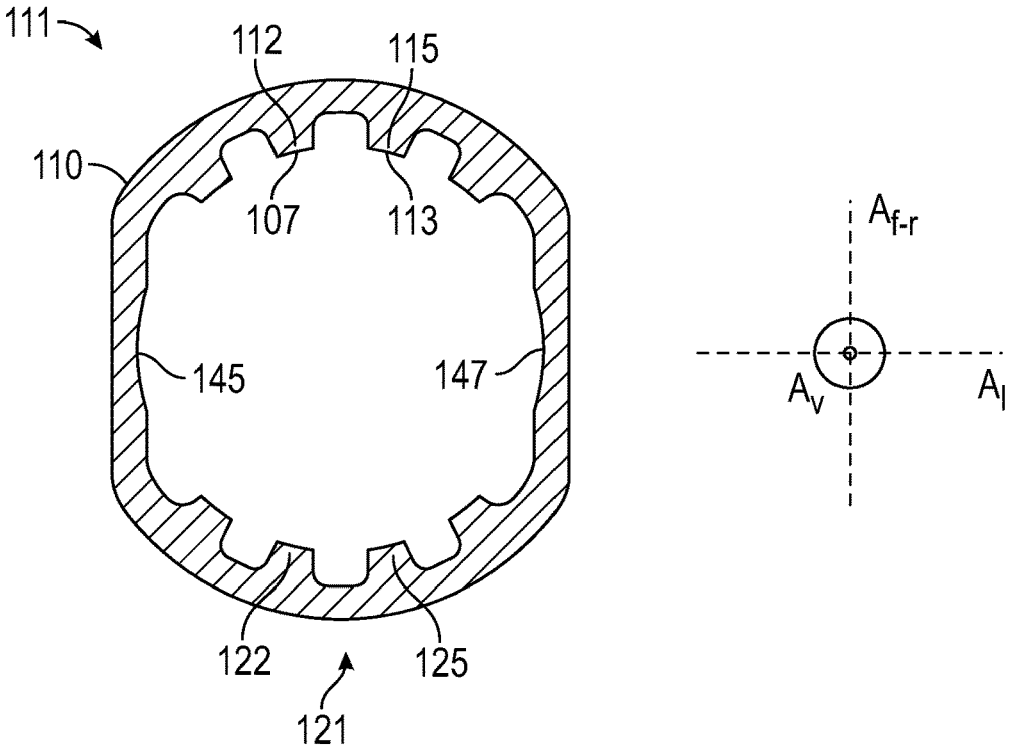
FIG. 20 is a cross-sectional top view of another exemplary tube of a mast of a davit.

If desired, in some embodiments the radially inward surfaces of the left and right lateral sidewalls may exhibit concave-inward scallops 145 and 147, as shown in exemplary embodiment in FIG. 20. Such a scallop or scallops may be e.g. centered on the forward-rearward centerline $C_{f\text{-}r}$ of the tube and may allow a circular coupler to be accommodated. If desired, one or more such scallops may be present on radially inward surface 107 of forward wall 111 of tube 110, and/or on radially inward surface 127 of rearward wall 121 of tube 110. In some embodiments, such a scallop may be a feature of an extruded tube as made; in such embodiments the scallop may extend the entire elongate length of the tube. In other embodiments, such a scallop may be produced by removal (e.g. machining, ablating, grinding or the like) of material. In such cases, such a scallop may extend the entire length of the tube; or, it may be preferentially located only at an end portion of the tube (e.g. to accommodate a circular coupler within the end portion of the tube, as discussed above).

In various embodiments, mast 100 of davit 1 may comprise one or more auxiliary reinforcing structures (whether in addition to, or instead of, any couplers 300 as described above). In some embodiments such a reinforcing structure or structures may serve primarily to enhance the mechanical stability of a junction (joint) of end-to-end stacked tubes 110. In some embodiments such a structure or structures may enhance the strength of an individual tube.

Figure 21:
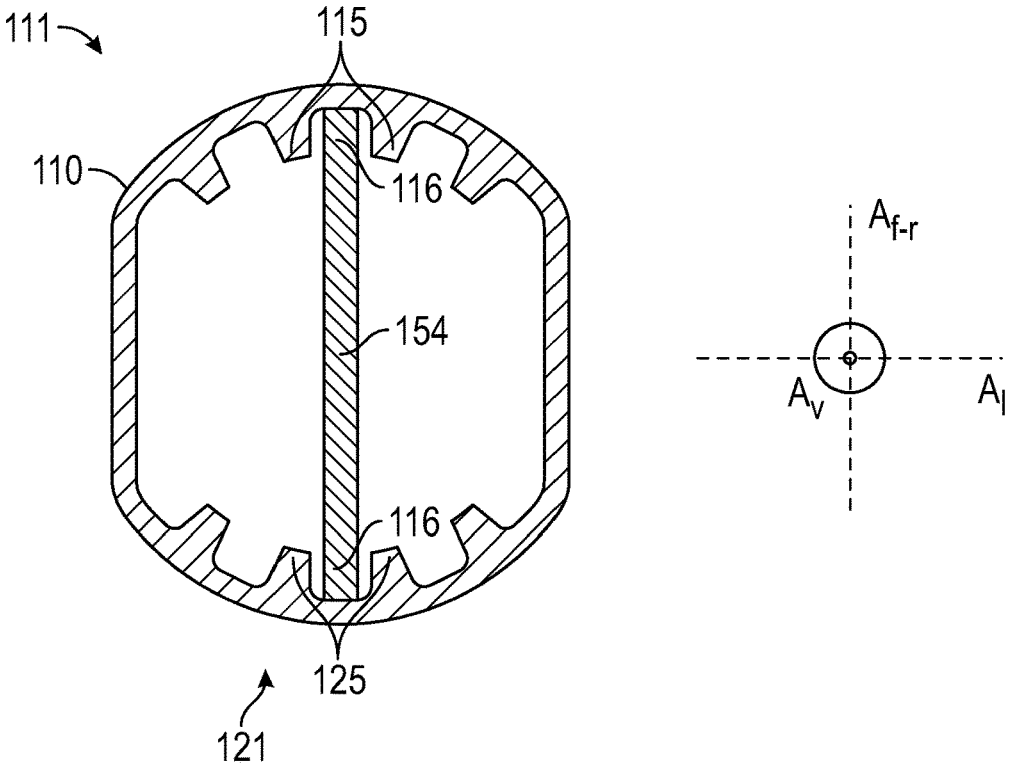
FIG. 21 is a cross-sectional top view of another exemplary tube of a mast of a davit, with a reinforcing beam fitted into the interior of the tube.

One such potentially suitable reinforcing structure is internal beam 154 as shown in exemplary embodiment in the top view of FIG. 21. Beam 154 may take the form of e.g. a spar, strut, flange or rib that is elongated along the vertical axis $A_v$ of a tube 111 within which spar 154 resides. In some embodiments a beam 154, when viewed along the vertical axis as in FIG. 21, may comprise a main body in the form of a single beam that extends at least generally forward-rearward as shown in exemplary embodiment in FIG. 21. In other embodiments a beam 154 may exhibit a main body e.g. in the form of an X-shape when viewed along axis $A_v$. In some embodiments, the forward and rearward edges of beam 154 may be configured to fit within gaps 116 between teeth 115 and 125 of the forward and rearward walls, as in the exemplary design of FIG. 21. Such a beam 154 may be solid; or, it may comprise multiple cut-outs e.g. to reduce the weight of the beam. Such a beam 154 may be made of any suitable material, e.g. aluminum or steel. Such a beam may extend along any desired extent of the length of a tube 110; e.g. it may extend along at least about 20, 40, 60, 80, 90, or essentially 100% of the length of the tube. (In the instance that both a reinforcing beam 154 and a coupler 300 are used, the coupler and beam may be configured so that they accommodate each other in the region of a tube-tube junction.)

Figure 22:
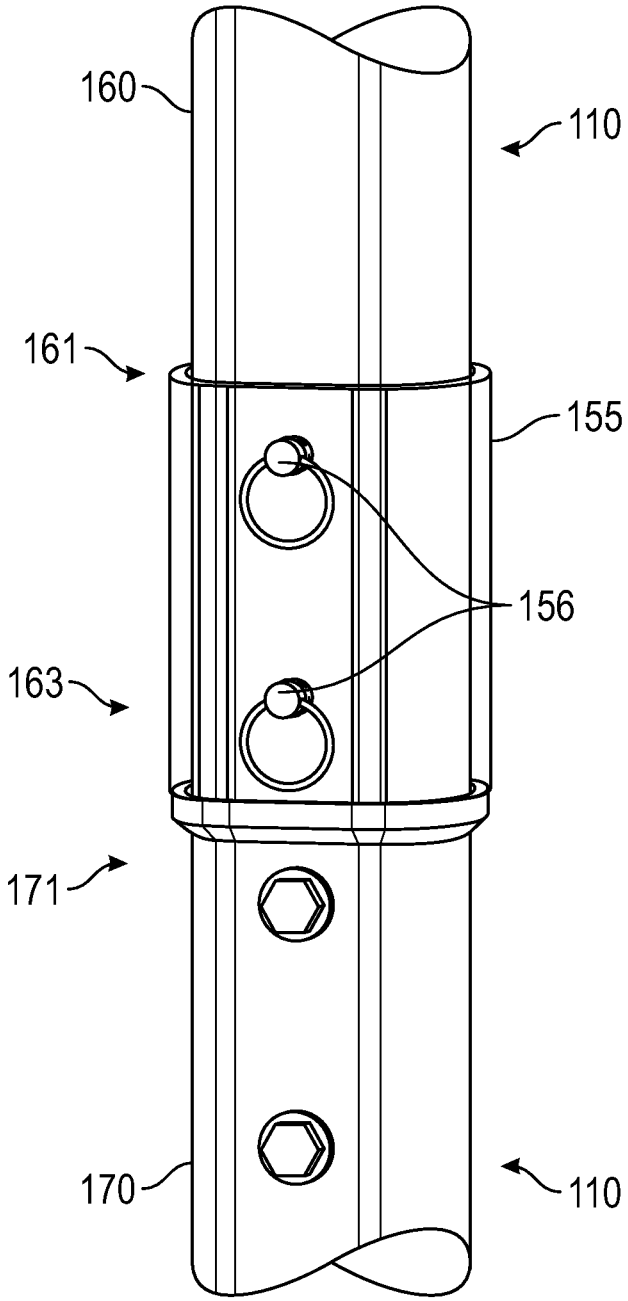
FIG. 22 is a side view of a junction between multiple tubes of a davit mast, with a reinforcing collar installed on the junction.

In some embodiments, one or more external collars or sleeves 155 may be used to enhance the mechanical stability of a junction 163 of end-to-end stacked tubes 110, as shown in exemplary embodiment in FIG. 22. Such a collar 155 may be fitted onto a junction 163 between two such tubes so that the collar overlaps the radially outer surface of upper portion 171 of a lower tube 170, and/or overlaps the radially outer surface of a lower portion 161 of an upper tube 160, to a desired extent. In some embodiments, such a collar 155 may be removable from both tubes, e.g. by way of removable fasteners (e.g. pins) 156 as shown in FIG. 22. In some embodiments, such a collar 155 may be permanently attached to an end of one tube (e.g. by welding, or by use of a permanent fastener) and may be e.g. reversibly attachable to the end of the other tube.

Such a collar 155 may be solid; or, it may comprise multiple cut-outs e.g. to reduce the weight of collar 155. Such a collar 155 may be made of any suitable material, e.g. aluminum or steel. Such a collar, when fitted into place e.g. at a tube-tube junction, may extend along any desired extent of the length of one or both tubes. For example, it may extend along at least about 5, 10, 15 or 20% of the length of one or both tubes. (In the instance that both a reinforcing collar 155 and a coupler 300 are used, the coupler and collar may be configured so that they accommodate each other in the region of a tube-tube junction.) In some embodiments two collars may be used, one at an end of a first tube, and the other at an end of a second tube that is to be mated to the first tube. In such embodiments, one such collar may be permanently attached to a first tube and another collar may be removably attached to a second tube.

Figure 23:
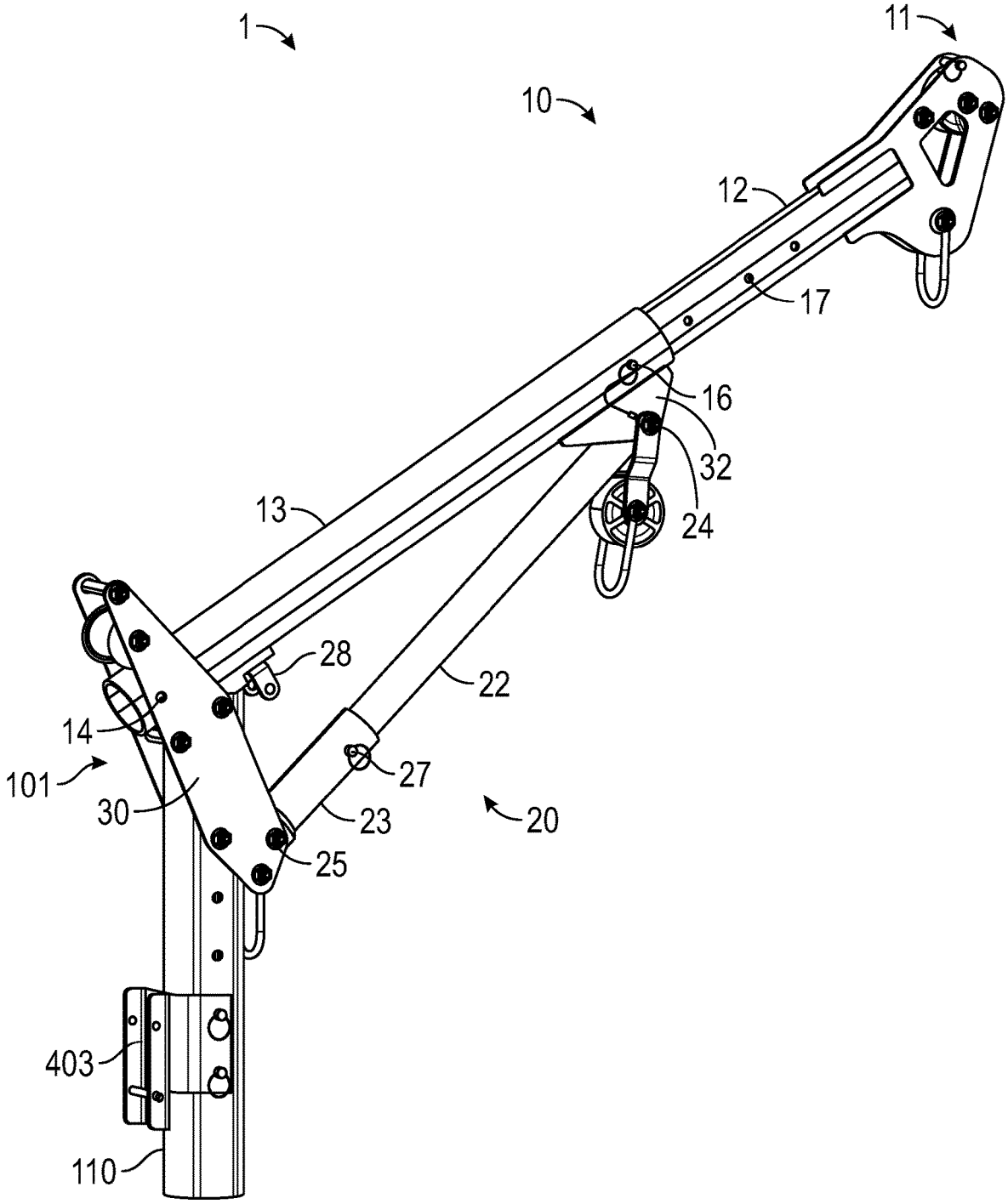
FIG. 23 is a side-rear perspective view of an upper portion of a mast and of a boom, of an exemplary davit.

As noted earlier, davit 1 comprises a boom 10 that extends forwardly from mast 100. Also as noted, boom 10 defines the forward-rearward axis $A_{f,r}$ of davit 1, boom 10, and of mast 100 and the one or more tubes 110 that make up mast 100. As noted earlier, davit 1 may be rotatable about a vertical axis of rotation; it is emphasized that the forward-rearward axis will always be defined by the boom without respect to the rotational position of the davit as a whole. In the exemplary design of FIG. 23, boom 10 comprises a forward section 12 comprising a boomhead 11, and a rearward section 13. Forward section 12 is telescopically movable with respect to rearward section 13 (that is, section 12 can be moved rearwardly into, and forwardly out of, section 13). However, sections 12 and 13 are not disconnectable from each other (in other words, section 12 cannot be pulled completely out of section 13). In some embodiments, a fastener (e.g. a pin 16 that passes through a set of aligned apertures in the forward and rearward sections 12 and 13 of the boom) may be used to hold these sections in a desired forward-rearward relationship. (Apertures 17 are visible in forward section 12 of boom 10 as shown in FIG. 23; pin 16 is passed through one such aperture, and through a complementary aperture of rearward section 13 of the boom, as evident from FIG. 23.) Pin 16 may be removed in order to change this relationship, after which pin 16 is re-inserted into a newly aligned set of apertures. However, as noted above, sections 12 and 13 are not disconnectable from each other, even with such a fastener removed.

Boom 10 (e.g. rearward section 13 thereof) may be made of any suitable material (e.g. any of the aluminum grades or other materials described earlier herein) and may comprise any suitable design. In some embodiments boom 10 may exhibit a cross-sectional configuration, when viewed along the long axis of the boom, similar to or identical to any of the above-described designs for tube 110 of mast 100. Thus, any of the previous descriptions and characterizations of tube 110 are applicable to boom 10 (e.g. to rearward section 13 thereof), except that the long axis of boom 10 will be used in place of the vertical axis of the mast.

Rearward section 13 of boom 10 is pivotally connected to an upper end portion 101 of mast 100 (i.e., to an upper end of an uppermost tube 110 of mast 100) by a pivotal connection 14. This pivotal connection of boom 10 to mast 100, which may be facilitated by use of bracket 30, allows that the vertical component of an angle at which boom 10 extends forwardly from mast 100 can be adjusted. This, along with the fact that boom forward section 12 can be telescoped forward and rearward relative to boom rearward section 13, can allow that boomhead 11 can be positioned as desired, e.g. at a suitable height and location centered over an entry of a confined space. (As noted earlier, the total height of mast 100 may also be adjusted e.g. by way of using one or more end-to-end mated tubes in combination.)

Davit 1 also comprises a gusset strut 20 that aids in supporting boom 10. Strut 20 comprises a rearward end that is pivotally connected by pivotal connection 25, to upper end portion 101 of mast 100 (e.g. facilitated by bracket 30). Pivotal connection 25 is below the pivotal connection 14 of boom 10 to upper end portion 101 of mast 100. Strut 20 comprises a forward end that is pivotally connected by pivotal connection 24, to boom 10 (specifically, to bracket 32 that is positioned at the forward end of rearward piece 13 of boom 10). Strut 20 thus acts to support boom 10. In the depicted embodiment, strut 20 is comprised of a forward section 22 and a rearward section 23, which sections are telescopically movable relative to each other. This, in combination with the pivotal connections of strut 20 to the mast and to the boom, allows strut 20 to be lengthened or shortened, and raised or lowered, to accommodate the desired positioning of boom 10. As noted, davit 1 may comprise one or more brackets 30 that facilitate the pivotal connecting of boom 10 and strut 20 to upper end portion 101 of mast 100, as shown in exemplary embodiment in FIGS. 20 and 21. Bracket 30 may comprise any number of fasteners and connectors (whether quick connect/release fasteners, or permanent fasteners) for such purposes.

In the depicted embodiment, forward and rearward sections 22 and 23 of strut 20, unlike forward and rearward sections 12 and 13 of boom 10, are disconnectable from each other. That is, in ordinary use of davit 1, sections 22 and 23 of strut 20 may be held together by any suitable fastener (e.g. pin 27 as shown in FIG. 23). However, the fastener can be unfastened (e.g. removed) and sections 22 and 23 of strut 20 can be disconnected from each other. As mentioned above, rearward section 13 of boom is disconnectably (and pivotally) connected to mast 100 e.g. by a removable fastener (e.g. a pin) 15. These arrangements allow boom 10 as a whole, including rearward section 13 and forward section 12, to be disconnected from mast 100 as shown in FIG. 24.

Figure 24:
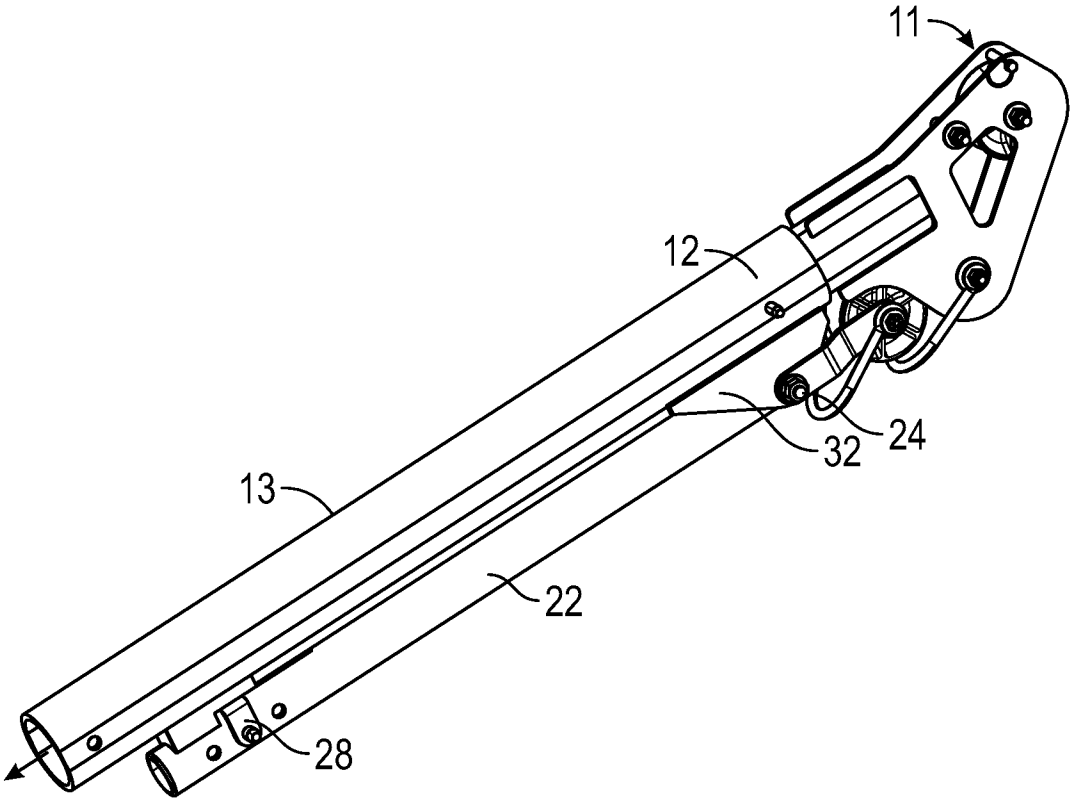
FIG. 24 is a side-rear perspective view of the davit of FIG. 20, with the boom having been detached from the mast.
Figure 24:
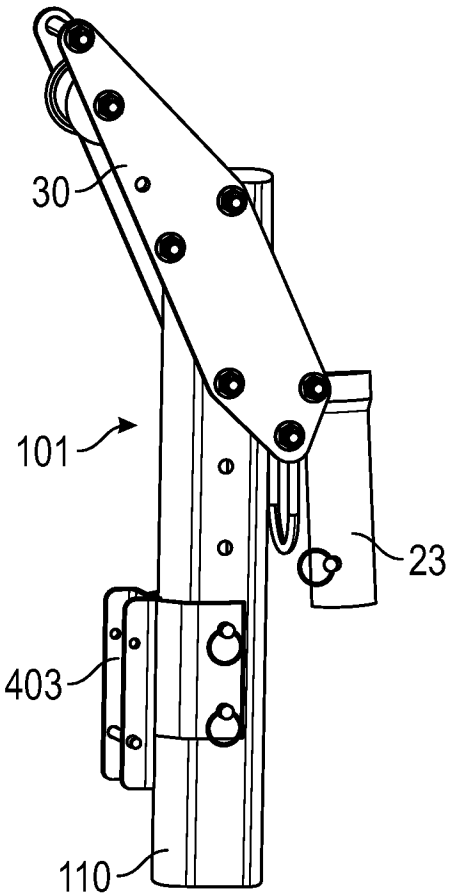

When boom 10 is disconnected from mast 100, forward section 22 of strut 20 can remain attached to boom 10, while rearward section 23 of strut 20 can remain attached to mast 100 (both as shown in FIG. 24). These arrangements provide that, e.g. when it is desired to move davit 1 to a new location, davit 1 can be separated into a first piece comprising mast 100 with rearward section 23 of strut 20 remaining attached thereto, and a second piece comprising boom 10 with forward section 22 of strut 20 remaining attached thereto. This can allow davit 1 to be disassembled into first and second pieces that may be of somewhat comparable weight, thus enhancing the ease of transporting the pieces, which are often carried by hand. Moreover, since the first davit piece does not include any portion of the boom and since the rearward section 23 of strut 20 is pivotally connected to tube 110 and thus can be rotated to a position close to tube 110, very few items (e.g. a portion of bracket 30) will protrude radially outwardly from mast 100 after disassembly of davit 1 in this manner. This means that the center of gravity of the first piece of disassembled davit 1 is closely aligned with the mast. This first piece is thus easier to carry by hand than would be a davit piece that includes the mast with a significant portion of a boom protruding outwardly therefrom. (Mast 100 may of course be further separated into individual tubes 110, in cases in which the mast is provided by multiple tubes as described earlier herein.)

To still further enhance the ease of carrying the pieces of the disassembled davit, the pivotal connection of forward section 22 of strut 20 to boom 10 allows that after the forward and rearward strut sections are separated from each other, the forward section 22 can be rotated about its pivotal connection to boom 10, into a docked position as shown in FIG. 24. In the docked position, forward section 22 is at least generally or substantially parallel to boom 10 (with regard to the long axis of each item). The center of gravity of this second piece of the disassembled davit will thus be closely aligned with the boom, rending this second piece of the disassembled davit easier to carry. Moreover, forward section 22 can be fastened to the boom while in this docked position (e.g. by use of a fastener or clasp 28 as shown in exemplary embodiment in FIG. 24). Forward section 22 can thus function as a handle by which this second piece of the disassembled davit may be carried. As shown in FIG. 24, forward section 12 of boom 10 can be telescoped into rearward section 13 of boom 10, to further reduce the size of boom 10 for enhanced portability of this second piece of the disassembled davit. It will be understood that the concept of a gusset strut that is separable into forward and rearward sections and which may have other features and attributes as disclosed above, is not limited to use in a davit that comprises a mast comprised of one or more tubes of the particular designs disclosed earlier herein. That is, such a gusset strut may be used in a davit that comprises a mast of any e.g. conventional design. (Likewise, the mast/tube designs and arrangements disclosed earlier herein do not necessarily have to be used in a davit that comprises a gusset strut as disclosed above).

Figure 25:
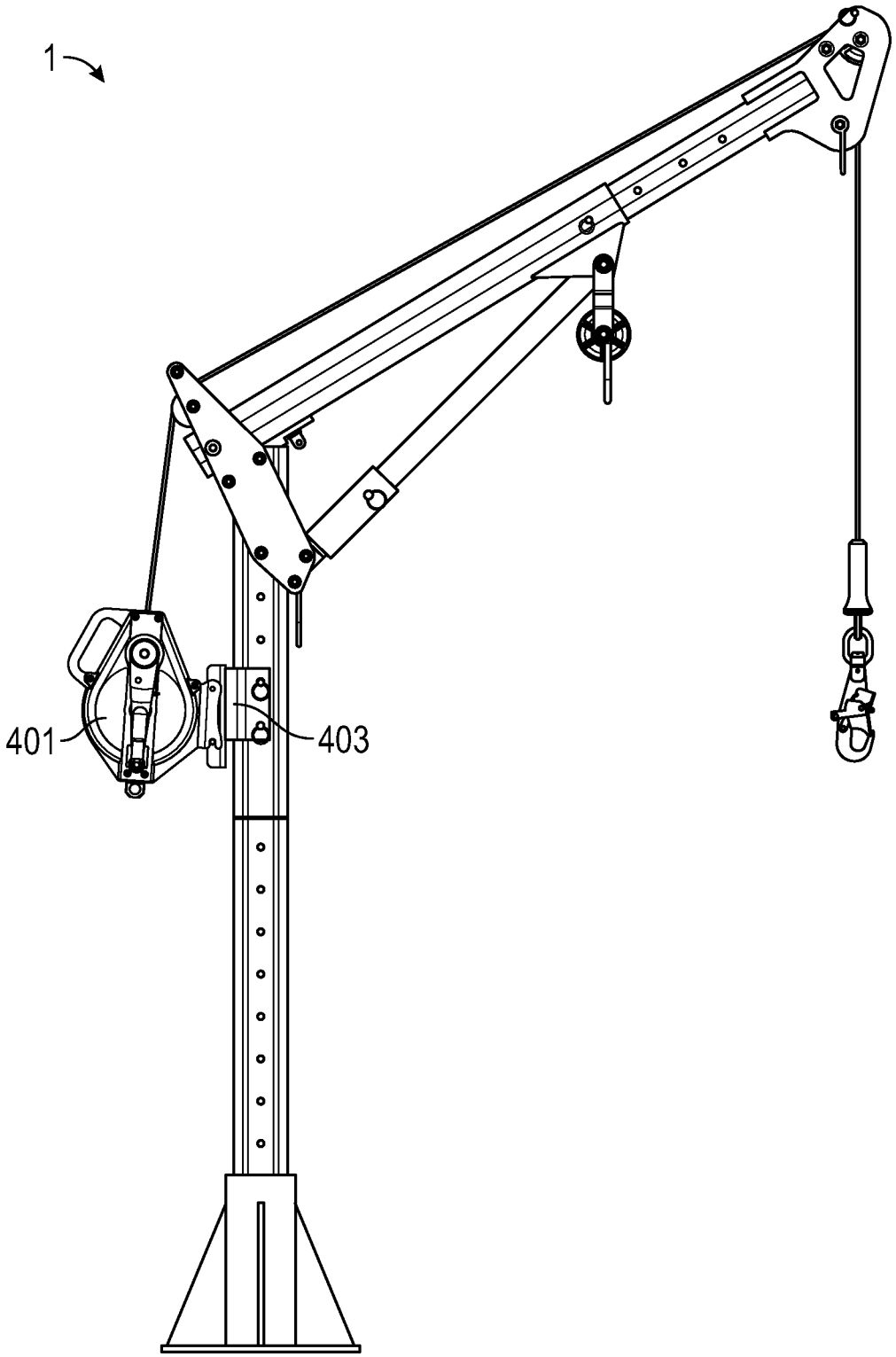
FIG. 25 is a side view of an exemplary davit comprising a self-retracting lifeline.

As noted earlier herein, in various embodiments davit 1 may comprise one or more of e.g. a winch and/or a self-retracting lifeline 401, as shown in exemplary embodiment in FIG. 25. Davit 1 thus may provide a hoisting/lowering function, and/or fall-protection, at various times as desired. Such devices may be permanently attached to the davit (e.g. may be permanently mounted at one particular location on the davit); or, they may be movable to different spots on the davit and/or removable from the davit. They may be front-mounted, or rear-mounted, e.g. on mast 100, e.g. by way of bracket 403 or any similar bracket. In some embodiments, such a device may be suspended from boom 10 rather than being mounted on mast 100. Such devices may be motorized; however, in many embodiments such devices may be manually (hand) operated.

Davit 1 may be provided with any number of suitable cables (made e.g. of metal, rope, etc., as desired), one end of which may be e.g. attached to a winch or self-retracting lifeline of the davit and the other end of which may comprise attachment (e.g. a hook, carabiner, D-ring, or the like) to allow that end to be attached e.g. to a harness of a worker. Davit 1 may comprise any number of pulleys, rollers, guides, anchor points, brackets, or the like, to support such a cable or cables in use of davit 1 (several such items are visible, unnumbered, in FIG. 25). Davit 1 may further comprise any number of U-rings or the like which may provide additional mounting or connection points for various ancillary equipment to be used in conjunction with davit 1. Davit 1 may comprise one or more level indicators as desired. Davit 1 can be used for any suitable purpose or combination of purposes, e.g. fall arrest, rescue, man-riding and/or material handling. In many applications, davit 1 can function as a variable-offset davit.

Davit 1 may be used with any suitable support base 200 (as described earlier) into which lower end portion 102 of mast 100 is inserted. In some embodiments, such a base may be a dedicated (fixed) base that is permanently installed at a particular location. In some embodiments, such a base may be portable and may be moved between locations. Whether fixed or portable, any such base may be e.g. flush-floor-mounted, sleeve-floor-mounted, barrel-mounted, wall-mounted, hitch-mounted, cart-mounted, or the like. In particular embodiments, such a base may be a part of a portable support stand that comprises at least three at least generally horizontally-extending support beams that collectively support the base. Such a support stand may be counterweighted if desired. In various embodiments, davit 1 may exhibit an acceptable ability to withstand forces of at least about 1800, 2200, 2500, 2800, or 3100 pounds, when measured according to the procedures outlined in Section 5.7.3 of Standard BS EN1496:2006: Personal Fall Protection Equipment—Rescue Lifting Devices. In some embodiments, davit 1 may be provided with an adaptor that may facilitate mounting of mast 100 into a pre-existing base. For example, if a tube 110 of a mast 100 comprises e.g. a nominal 4 inch outer diameter (as defined by the diameter of a common circle that the above-described forward and rearward arcs of the tube lie on) and it is desired to install such a mast into a base that defines a cavity with a 3 inch inner diameter, an adaptor may be used. Such an adaptor may e.g. comprise an upper portion that provides a cavity with a 4 inch ID to receive the mast, and a lower portion with a (nominal) 3 inch outer diameter that is insertable into the 3 inch inner-diameter cavity of the base.

Certain items and components have been described herein as being connectable. By this is specifically meant that the items are manually connectable, and disconnectable; i.e. they can be connected and disconnected from each other by hand, in the field, without necessitating the use of special tools such as e.g. pliers, a screwdriver, wrenches, and so on. The same applies to terms such as fastenable and unfastenable. It is further noted that many of the descriptions and characterizations herein are with respect to a mast, in particular to a tube of a mast, that is viewed in cross-section, along the vertical axis of the mast. All such descriptions (e.g., the use of such terms such as radially inward or outward, wall thickness, circumferentially extending, and so on) will be understood to apply under such conditions, if even the conditions are not explicitly stated for each individual description. Similarly, all references herein to angular arcs will be understood to denote arcs with a vertex located at the geometric center of the tube.

LIST OF EXEMPLARY EMBODIMENTS

Embodiment 1 is a confined-space davit, comprising: a vertical, elongate mast provided by at least one annular tube; and, a boom that is pivotally connected to an upper end portion of the mast and that extends forwardly from the mast to define a common forward-rearward axis of the davit, of the mast, and of the tube; wherein the tube comprises a forward wall and an opposing rearward wall, and comprises left and right opposing lateral sidewalls that each connect the forward wall to the rearward wall; wherein the tube comprises a forward-rearward extent, along the forward-rearward axis of the davit, the mast, and the tube, that is greater than a lateral width of the tube by a factor of at least 1.10; and wherein the forward and rearward walls of the tube each exhibit a maximum wall thickness that is greater than a maximum wall thickness of each lateral sidewall, by a factor of at least 1.10.

Embodiment 2 is the davit of embodiment 1 wherein at least some radially outerwardmost portions of a forward surface of the forward wall of the tube collectively define a forward arc and wherein at least some radially outerwardmost portions of a rearward surface of the rearward wall of the tube collectively define a rearward arc, and wherein the forward and rearward arcs both lie on a common circle with a common center and a common radius of curvature, the common circle falling outside at least some portion of a radially outward major surface of the left lateral sidewall of the tube and outside at least some portion of a radially outward major surface of the right lateral sidewall of the tube.

Embodiment 3 is the davit of any of embodiments 1-2 wherein the radially outward major surface of the left lateral sidewall and the radially outward major surface of the right lateral sidewall are each at least generally planar and are aligned within plus or minus 10 degrees of the forward-rearward axis of the davit, mast and tube. Embodiment 4 is the davit of any of embodiments 1-3 wherein the left and right opposing lateral sidewalls of the tube each comprise a wall thickness that is at least substantially uniform over at least 90% of a circumferential extent of each sidewall. Embodiment 5 is the davit of any of embodiments 1-4 wherein the forward and rearward walls of the tube each respectively occupy an angular arc that is centered on the forward-rearward axis of the davit, mast and tube and that extends through a range of from about 100 to about 140 degrees, and wherein the left and right opposing lateral sidewalls each respectively occupy an angular arc that is centered on a lateral axis of the davit, mast and tube and that extends through a range of from about 40 to about 80 degrees.

Embodiment 6 is the davit of any of embodiments 1-5 wherein the forward wall of the tube comprises an arcuate, circumferentially-extending forward base with a first end that is connected to the left lateral sidewall and with a second, opposing end that is connected to the right lateral sidewall, and wherein the forward base comprises at least one boss that integrally protrudes radially inward from the forward base; and, wherein the rearward wall of the tube comprises an arcuate, circumferentially-extending rearward base with a first end that is connected to the left lateral sidewall and with a second, opposing end that is connected to the right lateral sidewall, and wherein the rearward base comprises at least one boss that integrally protrudes radially inward from the forward base.

Embodiment 7 is the davit of embodiment 6 wherein the at least one boss of the forward wall of the tube extends circumferentially along a radially inward side of the forward base of the forward wall through an angular arc of at least about 20 degrees; and, wherein a lateral centerline of the tube passes through the at least one boss of the forward wall of the tube. Embodiment 8 is the davit of embodiment 6 wherein the at least one boss of the forward wall of the tube comprises at least two radially-inwardly-protruding teeth that are circumferentially spaced along at least a portion of a circumferential extent of a radially inward side of the forward base of the forward wall. Embodiment 9 is the davit of any of embodiments 6 and 8 wherein the at least one boss of the rearward wall of the tube comprises at least two radially-inwardly-protruding teeth that are circumferentially spaced along at least a portion of a circumferential extent of a radially inward side of the rearward base of the forward wall; and, wherein at least circumferential midpoints of the radially inwardmost major surfaces of the radially-inwardly-protruding teeth of the forward wall all lie on a forward arc and wherein at least circumferential midpoints of the radially inwardmost major surfaces of the radially-inwardly-protruding teeth of the rearward wall all lie on a rearward arc; and, wherein the forward and rearward arcs both lie on a common circle with a common center and a common radius of curvature, which common circle lies within a space between radially inwardmost surfaces of the left and right lateral sidewalls.

Embodiment 10 is the davit of embodiment 6 wherein the at least one boss of the forward wall of the tube is configured so that the forward wall exhibits a wall thickness, in a radially inward-outward direction, that is at least substantially uniform along an entire circumferential extent of the at least one boss. Embodiment 11 is the davit of embodiment 6 wherein the at least one boss of the forward wall of the tube is configured so that the forward wall exhibits a wall thickness, in a radially inward-outward direction, that varies by a factor of at least about 1.5 along a circumferential extent of the at least one boss, and so that the forward wall exhibits a maximum wall thickness at a location that is intersected by a lateral centerline of the tube.

Embodiment 12 is the davit of any of embodiments 1-5 wherein the forward wall of the tube comprises a thickness in a radially inward-outward direction of the tube that is at least substantially uniform over at least 90% of a circumferential extent of the forward wall of the tube. Embodiment 13 is the davit of any of embodiments 1-5 wherein radially inwardmost surfaces of the forward and rearward walls of the tube and of the left and right lateral sidewalls of the tube are provided by an integral, annular sleeve of the tube, which sleeve is configured so that the radially inwardmost surfaces of the forward and rearward and lateral sidewalls collectively define a circle.

Embodiment 14 is the davit of any of embodiments 1-13 wherein radially inwardmost portions of a radially inward surface of the forward wall of the tube all lie on a forward arc and wherein radially inwardmost portions of a radially inward surface of the rearward wall of the tube all lie on a rearward arc; and, wherein the forward and rearward arcs both lie on a common circle with a common center and a common radius of curvature, which common circle lies within a space between radially inwardmost locations of the left and right lateral sidewalls.

Embodiment 15 is the davit of any of embodiments 1-14 wherein the forward and rearward walls collectively provide at least 65% of the mass of the tube and wherein the left and right lateral sidewalls collectively provide no more than 35% of the mass of the tube. Embodiment 16 is the davit of any of embodiments 1-15 wherein the tube, when viewed along a long axis of the tube, exhibits $2^{nd}$-order rotational symmetry and does not exhibit rotational symmetry that is higher than $2^{nd}$-order. Embodiment 17 is the davit of any of embodiments 1-16 wherein the vertical, elongate mast comprises a single tube that provides an entire elongate length of the mast.

Embodiment 18 is the davit of any of embodiments 1-16 wherein the vertical, elongate mast comprises at least first and second tubes that are mated to each other in an end-to-end, longitudinally-aligned and rotationally-aligned manner, and are held in place by an elongate coupler with a lower portion that fits into a receiving space within an upper-end portion of the first tube and with an upper portion that fits into a receiving space within a lower-end portion of the second tube. Embodiment 19 is the davit of embodiment 18 wherein the coupler comprises at least one anti-rotation feature that physically interferes with rotation of the first tube relative to the coupler, and at least one anti-rotation feature that physically interferes with rotation of the second tube relative to the coupler, which anti-rotation features collectively prevent the first tube and the second tube from rotating relative to each other. Embodiment 20 is the davit of embodiment 19 wherein each anti-rotation feature comprises at least one boss that protrudes radially outward from a main body of the coupler. Embodiment 21 is the davit of embodiment 19 wherein the anti-rotation features are upper and lower portions of an elongate ridge that protrudes radially outwardly from a main body of the coupler and that exhibits a long axis that is aligned with a long axis of the coupler.

Embodiment 22 is the davit of any of embodiments 1-21 wherein a lowermost end of the mast is configured to fit within an upwardly-open-ended cavity defined within radially-inwardmost walls of a support base, so that the mast and the boom connected to the upper end portion thereof can be rotated relative to the support base, around a rotation axis that coincides with the vertical axis of the mast and with a long axis of the tube. Embodiment 23 is the davit of embodiment 22 wherein the davit is configured to be movable between different use locations and is configured to be installed at a use location by way of the lowermost end of the mast being inserted into the cavity of a support base that is installed at the use location. Embodiment 24 is the davit of embodiment 22 wherein the support base is part of a portable support stand that comprises at least three horizontally-extending support beams that collectively stabilize the support base.

Embodiment 25 is a confined-space davit, comprising: a vertical, elongate mast and a boom that is pivotally connected to an upper end portion of the mast and that extends forwardly from the mast to define a common forward-rearward axis of the davit and of the mast, wherein the davit further comprises a gusset strut with a rearward end that is pivotally connected to the upper end portion of the mast at a location below the pivotal connection of the boom to the upper end portion of the mast, and with a forward end that is pivotally connected to the boom, wherein the gusset strut can be lengthened or shortened to change a vertical component of an angle at which the boom extends forwardly from the boom.

Embodiment 26 is the davit of embodiment 25 wherein the gusset strut comprises a forward section and a rearward section, the forward and rearward sections of the gusset strut being telescopically movable relative to each other to lengthen or shorten the gusset strut; and, wherein the forward and rearward sections of the gusset strut are disconnectable from each other.

Embodiment 27 is the davit of embodiment 26 wherein the forward section of the gusset strut is configured so that upon the forward section of the gusset strut being disconnected from the rearward section of the gusset strut the forward section of the gusset strut can be rotated about the pivotal connection to the boom to a docked position in which the forward section of the gusset strut is at least substantially parallel to the boom; and, wherein the boom comprises at least one fastener whereby the forward section of the gusset strut can reversibly fastened to the boom when the forward section of the gusset strut is in the docked position.

Embodiment 28 is the davit of any of embodiments 25-27 wherein the boom comprises a rearward section that is pivotally connected to the upper end portion of the mast and to which the forward end of the gusset strut is pivotally connected, and a forward section that comprises a forward boomhead; and wherein the forward and rearward sections of the boom are telescopically movable back and forth relative to each other but are not disconnectable from each other. Embodiment 29 is the davit of embodiment 28 wherein the davit is reversibly disassemblable into at least a first piece comprising the at least one tube with the rearward section of the gusset strut pivotally connected thereto; and, a second piece comprising the forward and rearward sections of the boom with the forward section of the gusset strut pivotally connected to the rearward section of the boom.

Embodiment 30 is the davit of any of embodiments 1-24 further comprising a gusset strut of any of embodiments 25-27. Embodiment 31 is the davit of any of embodiments 1-27 further comprising a boom of any of embodiments 28-29. Embodiment 32 is the davit of any of embodiments 1-31 further comprising at least one winch and/or at least one self-retracting lifeline that is connected to the davit and is supported by the davit. Embodiment 33 is the davit of embodiment 32 wherein a boomhead of the boom comprises at least one roller configured to support and guide a cable of a winch or of a self-retracting lifeline.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). Although various theories and possible mechanisms may have been discussed herein, in no event should such discussions serve to limit the claimable subject matter. To the extent that there is any conflict or discrepancy between this specification as written and the disclosure in any document that is incorporated by reference herein but to which no priority is claimed, this specification as written will control.

What is claimed is:

1. A confined-space davit, comprising:

a vertical, elongate mast provided by at least one monolithic annular extruded aluminum tube;

and, a boom that is pivotally connected to an upper end portion of the mast and that extends forwardly from the mast to define a common forward-rearward axis of the davit, of the mast, and of the tube;

wherein the tube comprises a forward wall and an opposing rearward wall, and comprises left and right opposing lateral sidewalls that each connect the forward wall to the rearward wall;

wherein the tube comprises a forward-rearward extent, along the forward-rearward axis of the davit, the mast, and the tube, that is greater than a lateral width of the tube by a factor of at least 1.10;

wherein the forward and rearward walls of the tube each exhibit a maximum wall thickness that is greater than a maximum wall thickness of each lateral sidewall, by a factor of at least 1.10;

and, wherein at least some radially outerwardmost portions of a forward surface of the forward wall of the tube collectively define a forward arc and wherein at least some radially outerwardmost portions of a rearward surface of the rearward wall of the tube collectively define a rearward arc, and wherein the forward and rearward arcs both lie on a common circle with a common center and a common radius of curvature, the common circle falling outside at least some portion of a radially outward major surface of the left lateral sidewall of the tube and outside at least some portion of a radially outward major surface of the right lateral sidewall of the tube.

2. The davit of claim 1 wherein the radially outward major surface of the left lateral sidewall and the radially outward major surface of the right lateral sidewall are each at least generally planar and are aligned within plus or minus 10 degrees of the forward-rearward axis of the davit, mast and tube.

3. The davit of claim 1 wherein the left and right opposing lateral sidewalls of the tube each comprise a wall thickness that is at least substantially uniform over at least 90% of a circumferential extent of each sidewall.

4. The davit of claim 1 wherein the forward and rearward walls of the tube each respectively occupy an angular arc that is centered on the forward-rearward axis of the davit, mast and tube and that extends through a range of from about 100 to about 140 degrees, and wherein the left and right opposing lateral sidewalls each respectively occupy an angular arc that is centered on a lateral axis of the davit, mast and tube and that extends through a range of from about 40 to about 80 degrees.

5. The davit of claim 1 wherein the forward wall of the tube comprises an arcuate, circumferentially-extending forward base with a first end that is connected to the left lateral sidewall and with a second, opposing end that is connected to the right lateral sidewall, and wherein the forward base comprises at least one boss that integrally protrudes radially inward from the forward base; and, wherein the rearward wall of the tube comprises an arcuate, circumferentially-extending rearward base with a first end that is connected to the left lateral sidewall and with a second, opposing end that is connected to the right lateral sidewall, and wherein the rearward base comprises at least one boss that integrally protrudes radially inward from the forward base.

6. The davit of claim 5 wherein the at least one boss of the forward wall of the tube extends circumferentially along a radially inward side of the forward base of the forward wall through an angular arc of at least about 20 degrees; and, wherein a lateral centerline of the tube passes through the at least one boss of the forward wall of the tube.

7. The davit of claim 5 wherein the at least one boss of the forward wall of the tube comprises at least two radially-inwardly-protruding teeth that are circumferentially spaced along at least a portion of a circumferential extent of a radially inward side of the forward base of the forward wall.

8. The davit of claim 5 wherein the at least one boss of the rearward wall of the tube comprises at least two radially-inwardly-protruding teeth that are circumferentially spaced along at least a portion of a circumferential extent of a radially inward side of the rearward base of the forward wall; and, wherein at least circumferential midpoints of the radially inwardmost major surfaces of the radially-inwardly-protruding teeth of the forward wall all lie on a forward arc and wherein at least circumferential midpoints of the radially inwardmost major surfaces of the radially-inwardly-protruding teeth of the rearward wall all lie on a rearward arc; and, wherein the forward and rearward arcs both lie on a common circle with a common center and a common radius of curvature, which common circle lies within a space between radially inwardmost surfaces of the left and right lateral sidewalls.

9. The davit of claim 5 wherein the at least one boss of the forward wall of the tube is configured so that the forward wall exhibits a wall thickness, in a radially inward-outward direction, that varies by a factor of at least about 1.5 along a circumferential extent of the at least one boss, and so that the forward wall exhibits a maximum wall thickness at a location that is intersected by a lateral centerline of the tube.

10. The davit of claim 1 wherein radially inwardmost portions of a radially inward surface of the forward wall of the tube all lie on a forward arc and wherein radially inwardmost portions of a radially inward surface of the rearward wall of the tube all lie on a rearward arc; and, wherein the forward and rearward arcs both lie on a common circle with a common center and a common radius of curvature, which common circle lies within a space between radially inwardmost locations of the left and right lateral sidewalls.

11. The davit of claim 1 wherein the forward and rearward walls collectively provide at least 65% of the mass of the tube and wherein the left and right lateral sidewalls collectively provide no more than 35% of the mass of the tube.

12. The davit of claim 1 wherein the vertical, elongate mast comprises a single monolithic annular extruded aluminum tube that provides an entire elongate length of the mast.

13. The davit of claim 1 wherein the vertical, elongate mast comprises at least first and second monolithic annular extruded aluminum tubes that are mated to each other in an end-to-end, longitudinally-aligned and rotationally-aligned manner, and are held in place by an elongate coupler with a lower portion that fits into a receiving space within an upper-end portion of the first tube and with an upper portion that fits into a receiving space within a lower-end portion of the second tube.

14. The davit of claim 13 wherein the coupler comprises at least one anti-rotation feature that physically interferes with rotation of the first tube relative to the coupler, and at least one anti-rotation feature that physically interferes with rotation of the second tube relative to the coupler, which anti-rotation features collectively prevent the first tube and the second tube from rotating relative to each other.

15. The davit of claim 14 wherein each anti-rotation feature comprises at least one boss that protrudes radially outward from a main body of the coupler.

16. The davit of claim 14 wherein the anti-rotation features are upper and lower portions of an elongate ridge that protrudes radially outwardly from a main body of the coupler and that exhibits a long axis that is aligned with a long axis of the coupler.

17. The davit of claim 1 wherein a lowermost end of the mast is configured to fit within an upwardly-open-ended cavity defined within radially-inwardmost walls of a support base, so that the mast and the boom connected to the upper end portion thereof can be rotated relative to the support base, around a rotation axis that coincides with the vertical axis of the mast and with a long axis of the tube.

18. The davit of claim 1 wherein the davit further comprises a gusset strut with a rearward end that is pivotally connected to the upper end portion of the mast at a location below the pivotal connection of the boom to the upper end portion of the mast, and with a forward end that is pivotally connected to the boom, wherein the gusset strut can be lengthened or shortened to change a vertical component of an angle at which the boom extends forwardly from the boom, and wherein the gusset strut comprises a forward section and a rearward section, the forward and rearward sections of the gusset strut being telescopically movable relative to each other to lengthen or shorten the gusset strut; and, wherein the forward and rearward sections of the gusset strut are disconnectable from each other.

19. The davit of claim 18 wherein the forward section of the gusset strut is configured so that upon the forward section of the gusset strut being disconnected from the rearward section of the gusset strut the forward section of the gusset strut can be rotated about the pivotal connection to the boom to a docked position in which the forward section of the gusset strut is at least substantially parallel to the boom; and, wherein the boom comprises at least one fastener whereby the forward section of the gusset strut can reversibly fastened to the boom when the forward section of the gusset strut is in the docked position.

20. The davit of claim 1 further comprising at least one winch and/or at least one self-retracting lifeline that is connected to the davit and is supported by the davit.

* * * * *